US007920807B2

(12) United States Patent
Tomatsu

(10) Patent No.: US 7,920,807 B2
(45) Date of Patent: Apr. 5, 2011

(54) IMAGE FORMING APPARATUS HAVING A TRANSLATION MEMBER FOR SEPARATING A PHOTOSENSITIVE MEMBER FROM A DEVELOPING MEMBER

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 153 days.

(21) Appl. No.: 12/394,580

(22) Filed: Feb. 27, 2009

(65) Prior Publication Data

US 2009/0220273 A1 Sep. 3, 2009

(30) Foreign Application Priority Data

Feb. 29, 2008 (JP) ..... 2008-050665

(51) Int. Cl.
*G03G 21/18* (2006.01)
*G03G 15/08* (2006.01)

(52) U.S. Cl. ..... 399/112; 399/119

(58) Field of Classification Search ..... 399/110, 399/111, 119, 126, 113, 112
See application file for complete search history.

(56) References Cited

U.S. PATENT DOCUMENTS

| | | | | |
|---|---|---|---|---|
| 6,453,136 | B1 * | 9/2002 | Yasumaru | 399/111 |
| 7,444,087 | B2 | 10/2008 | Ishii | |
| 7,684,728 | B2 | 3/2010 | Okabe et al. | |
| 2004/0131380 | A1 * | 7/2004 | Kuma et al. | 399/110 |
| 2006/0177230 | A1 | 8/2006 | Ishii | |
| 2007/0077087 | A1 | 4/2007 | Okabe et al. | |
| 2007/0160386 | A1 | 7/2007 | Kawamura | |
| 2007/0160388 | A1 | 7/2007 | Yoshimura et al. | |
| 2007/0183814 | A1 | 8/2007 | Kamimura | |
| 2007/0217818 | A1 * | 9/2007 | Shiraki et al. | 399/111 |
| 2008/0260419 | A1 * | 10/2008 | Seike et al. | 399/110 |

FOREIGN PATENT DOCUMENTS

| | | | |
|---|---|---|---|
| JP | 2001-318506 | A | 11/2001 |
| JP | 2004-013030 | A | 1/2004 |
| JP | 2006-201493 | A | 8/2006 |
| JP | 2007-101635 | A | 4/2007 |
| JP | 2007-178654 | | 7/2007 |
| JP | 2007-213024 | | 8/2007 |
| JP | 2007-213025 | | 8/2007 |

* cited by examiner

*Primary Examiner* — Susan S Lee
(74) *Attorney, Agent, or Firm* — Banner & Witcoff, Ltd.

(57) ABSTRACT

An image forming apparatus includes a main body; a tandem type photosensitive unit, retaining photosensitive drums, mounted in the body and movable along the arrangement direction of the drums; and a developer cartridge provided for each drum, retaining a developing roller and detachably mounted on the unit. The apparatus also includes a translation member provided in the body and movable in the arrangement direction; and a link member corresponding to each cartridge and displaced to a position where a first end portion opposed to a prescribed portion of each cartridge, and a second end portion opposite to the first end portion and pressed by the translation member so the first end portion presses the prescribed portion to separate the roller from the drum and a position where the translation member is released from pressing the second end portion and the first end portion is released from pressing the prescribed portion.

8 Claims, 24 Drawing Sheets

82

81

IMAGE FORMING APPARATUS HAVING A TRANSLATION MEMBER FOR SEPARATING A PHOTOSENSITIVE MEMBER FROM A DEVELOPING MEMBER

CROSS REFERENCE TO RELATED APPLICATION

This application claims priority to Japanese Patent Application No. 2008-050665 filed on Feb. 29, 2008, the disclosure of which is hereby incorporated into the present application by reference.

TECHNICAL FIELD

The present invention relates to an image forming apparatus such as a color laser printer.

BACKGROUND

The so-called tandem type color printer is known as an electrophotographic color printer formed by parallelly arranging photosensitive drums corresponding to yellow, magenta, cyan and black respectively.

The tandem type color printer includes a developing roller opposed to each photosensitive drum. An electrostatic latent image is formed on the surface of the photosensitive drum. When the electrostatic latent image is opposed to the developing roller following rotation of the photosensitive drum, the developing roller feeds a toner to the electrostatic latent image. Thus, a toner image is formed on the surface of the photosensitive drum. A sheet is transported by a belt to be successively opposed to the photosensitive drums respectively. Toner images of the corresponding colors are formed on the photosensitive drums respectively and transferred to the sheet in a superposed manner, to form a color image on the sheet. On the other hand, a black toner image is formed only on the black photosensitive drum and transferred to the sheet, to form a monochromatic image on the sheet.

When the monochromatic image is formed, no toner images are formed on the remaining photosensitive drums of yellow, magenta and cyan except black, and hence the corresponding developing rollers are desirably separated from the yellow, magenta and cyan photosensitive drums respectively, to be prevented from consumption.

Therefore, an image forming apparatus including a translation cam member linearly movable in the direction of arrangement of photosensitive drums and intermediate members displaced by linear movement of the translation cam member for separating the photosensitive drums from developing rollers by pressing developing apparatuses upward is proposed as a tandem type image forming apparatus. The translation cam member so linearly moves as to switch the image forming apparatus to an all-color separation state where the developing rollers are separated from all photosensitive drums, a black contact state where the corresponding developing roller is in contact with a black photosensitive drum while the remaining developing rollers are separated from yellow, magenta and cyan photosensitive drums, and an all-color contact state where the developing rollers are in contact with all photosensitive drums.

In the image forming apparatus according to this proposal, the photosensitive drums of the four colors are integrally retained on a drum unit, which is mountable on/detachable from a main body. The developing apparatuses of the respective colors are detachably mounted on the drum unit.

In the conventional structure according to this proposal, however, the drum unit may positionally deviate from the main body due to force applied from the intermediate members to the developing apparatuses when the former presses the latter. When the drum unit positionally deviates from the main body, an image formed on a sheet also positionally deviates following this deviation.

SUMMARY

One aspect of the present invention may provide an image forming apparatus capable of preventing a tandem type photosensitive unit from positionally deviating from a main body when a developing roller is separated from a photosensitive drum.

The same or different aspect of the present invention may provide an image forming apparatus including: a main body; a tandem type photosensitive unit, integrally retaining a plurality of photosensitive drums in a parallelly arranged state, mounted in the main body to be movable along the direction of the arrangement of the photosensitive drums; a developer cartridge provided correspondingly to each photosensitive drum, retaining a developing roller for feeding a developer to the corresponding photosensitive drum and detachably mounted on the tandem type photosensitive unit; a translation member provided in the main body to be linearly movable in the direction of the arrangement; and a link member provided correspondingly to each developer cartridge, swingably supported on a first support shaft projecting provided on the tandem type photosensitive unit and displaced to a pressing position where a first end portion thereof is opposed to a prescribed portion of each developer cartridge while a second end portion opposite to the first end portion is pressed by the translation member following linear movement of the translation member so that the first end portion presses the prescribed portion in a direction for separating the developing roller from the photosensitive drum and a releasing position where the translation member is released from pressing the second end portion so that the first end portion is released from pressing the prescribed portion, while each developer cartridge is mounted on the tandem type photosensitive unit.

DETAILED DESCRIPTION

An embodiment of the present invention is now described with reference to the drawings.

1. Overall Structure of Color Laser Printer

Figure 1:
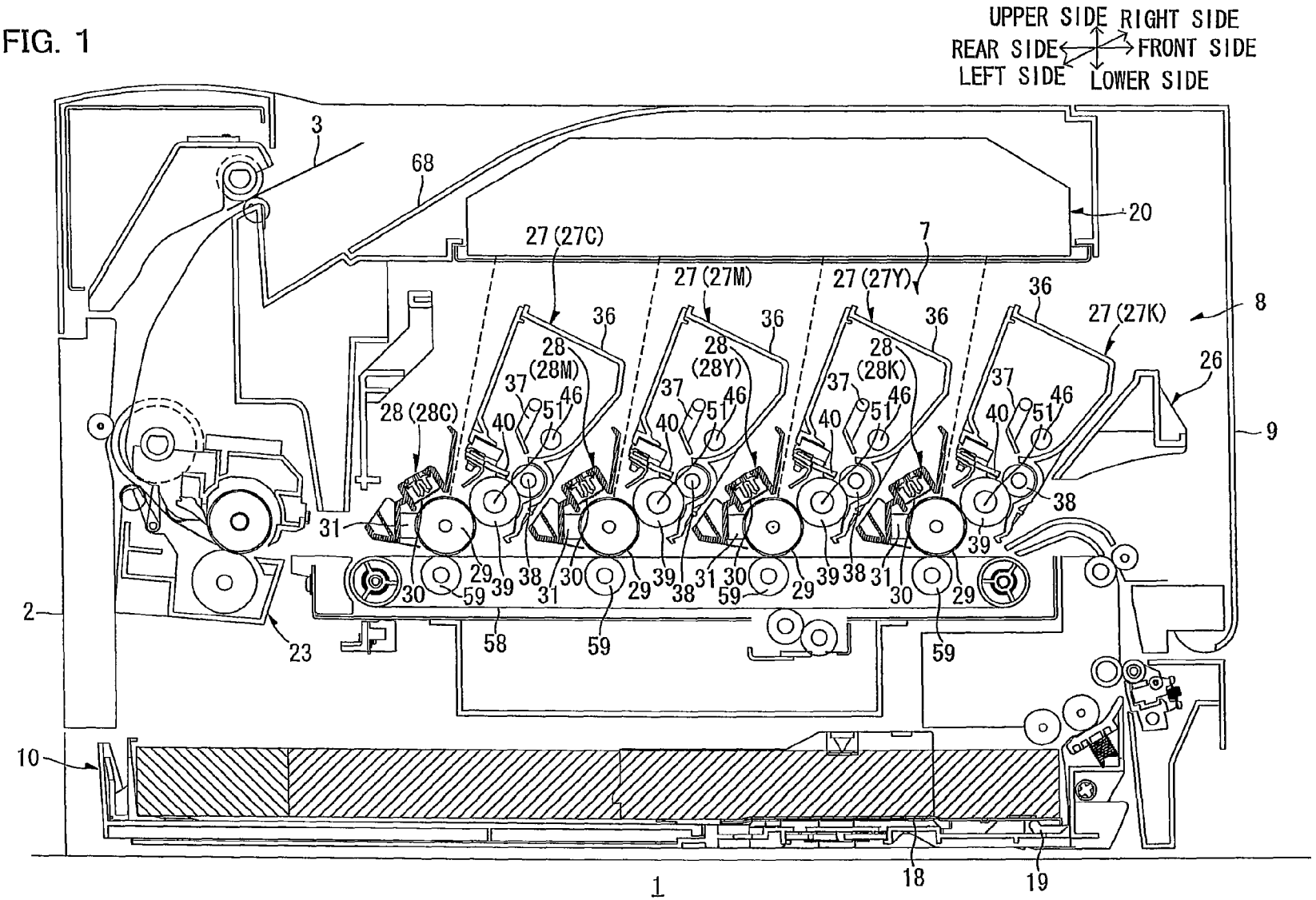
FIG. 1 is a side sectional view showing a color laser printer according to an embodiment of the present invention.

FIG. 1 is a side sectional view showing a color laser printer according to an embodiment as an example of an image forming apparatus according to the present invention.

A color laser printer 1 is a tandem type color laser printer including a main body casing 2 as an example of a main body. A front cover 9 is provided on one side surface of the main body casing 2 in an openable/closable manner.

In the following description, it is assumed that the side (right side in FIG. 1) provided with the front cover 9 is the front side, and the opposite side (left side in FIG. 1) is the rear side. The right and left sides are decided with reference to the color laser printer 1 as viewed from the front side. The right-and-left direction may hereinafter be referred to as the width direction. A drum unit 26 is described with reference to directions in a state mounted on the main body casing 2, unless otherwise stated.

The drum unit 26 as an example of a tandem type photosensitive unit is provided in the main body casing 2. A mounting port 8 is formed on the front surface of the main body casing 2. The drum unit 26 is mountable in and detachable from the main body casing 2 through the mounting port 8 in a state where the front cover 9 is opened.

The drum unit 26 includes four photosensitive drums 29, four drum subunits 28 and four developer cartridges 27. The developer cartridges 27 are mountable on and detachable from the photosensitive drums 29 and the drum subunits 28.

The photosensitive drums 29 are provided correspondingly to black, yellow, magenta and cyan respectively. The photosensitive drums 29 are parallelly arranged along the anteroposterior direction in the order of black, yellow, magenta and cyan at regular intervals from one another in the anteroposterior direction.

The drum subunits 28 are provided in one-to-one correspondence to the photosensitive drums 29. The drum subunits 28 are arranged at the back of the photosensitive drums 29 corresponding thereto respectively. The drum subunits 28 retain scorotron chargers 30 and cleaning brushes 31 respectively.

The developer cartridges 27 are provided in one-to-one correspondence to the photosensitive drums 29. The developer cartridges 27 are arranged in front of the photosensitive drums 29 corresponding thereto respectively. The developer cartridges 27 include boxy casings 36 whose lower end portions are opened rearward. Agitators 37, feed rollers 38, developing rollers 39 and layer-thickness regulating blades 40 are retained in the casings 36. The developing rollers 39 are arranged to be exposed rearward from the casings 36, and rotatably supported on both side walls of the casings 36 in the right-and-left direction. Both end portions of roller shafts 51 of the developing rollers 39 protrude outward from both sidewalls of the casings 36 in the right-and-left direction. The casings 36 accommodate toners of the respective colors. Detection windows 46 are formed on both sidewalls of the casings 36 in the right-and-left direction. The detection windows 46 transmit detection light for detecting the quantities of the toners remaining in the casings 36. According to this embodiment, the developing rollers 39 and the photosensitive drums 29 are in contact with one another. One-component developers are employed as the toners. In other words, the color laser printer 1 according to this embodiment employs a contact one-component developing system.

The surfaces of the photosensitive drums 29 are uniformly charged by the scorotron chargers 30. Thereafter the surfaces of the photosensitive drums 29 are selectively exposed by light from an exposure unit 20 arranged above the drum unit 26. Electrostatic latent images based on image data are formed on the surfaces of the photosensitive drums 29 due to this exposure. In the developer cartridges 27, on the other hand, the toners accommodated in the casings 36 are agitated and transported by the agitators 37, and fed onto the developing rollers 39 through the feed rollers 38. The toners fed onto the developing rollers 39 are regulated to constant thicknesses by the layer-thickness regulating blades 40, and carried on the developing rollers 39 as thin layers. When the electrostatic latent images are opposed to the developing rollers 39 following rotation of the photosensitive drums 29, the developing rollers 39 feed the toners to the electrostatic latent images, for visualizing the electrostatic latent images with the toners. Thus, toner images are formed on the surfaces of the photosensitive drums 29.

A sheet feeding cassette 10 accommodating sheets 3 is arranged on a bottom portion of the main body casing 2. The sheets 3 accommodated in the sheet feeding cassette 10 are transported onto a transport belt 58 by various rollers. The transport belt 58 is opposed to the four photosensitive drums 29 from below. Transfer rollers 59 are arranged on positions opposed to the photosensitive drums 29 through an upper portion of the transfer belt 58 respectively. The sheets 3 transported onto the transport belt 58 successively pass through the spaces between the transport belt 58 and the photosensitive drums 29 due to traveling of the transport belt 58. The toner images formed on the surfaces of the photosensitive drums 29 are transferred to the sheets 3 by transfer biases applied to the transfer rollers 59, when the same are opposed to the sheets 3.

A fuser 23 is provided on a downstream side of the transport belt 58 in the direction for transporting the sheets 3. The sheets 3 having the toner images transferred thereto are transported to the fuser 23. The fuser 23 fixes the toner images to the sheets 3 by heating and pressing. The sheets 3 having the toner images fixed thereto are ejected onto a sheet ejection tray 68 provided on the upper surface of the main body casing 2 by various rollers.

2. Drum Unit

Figure 2:
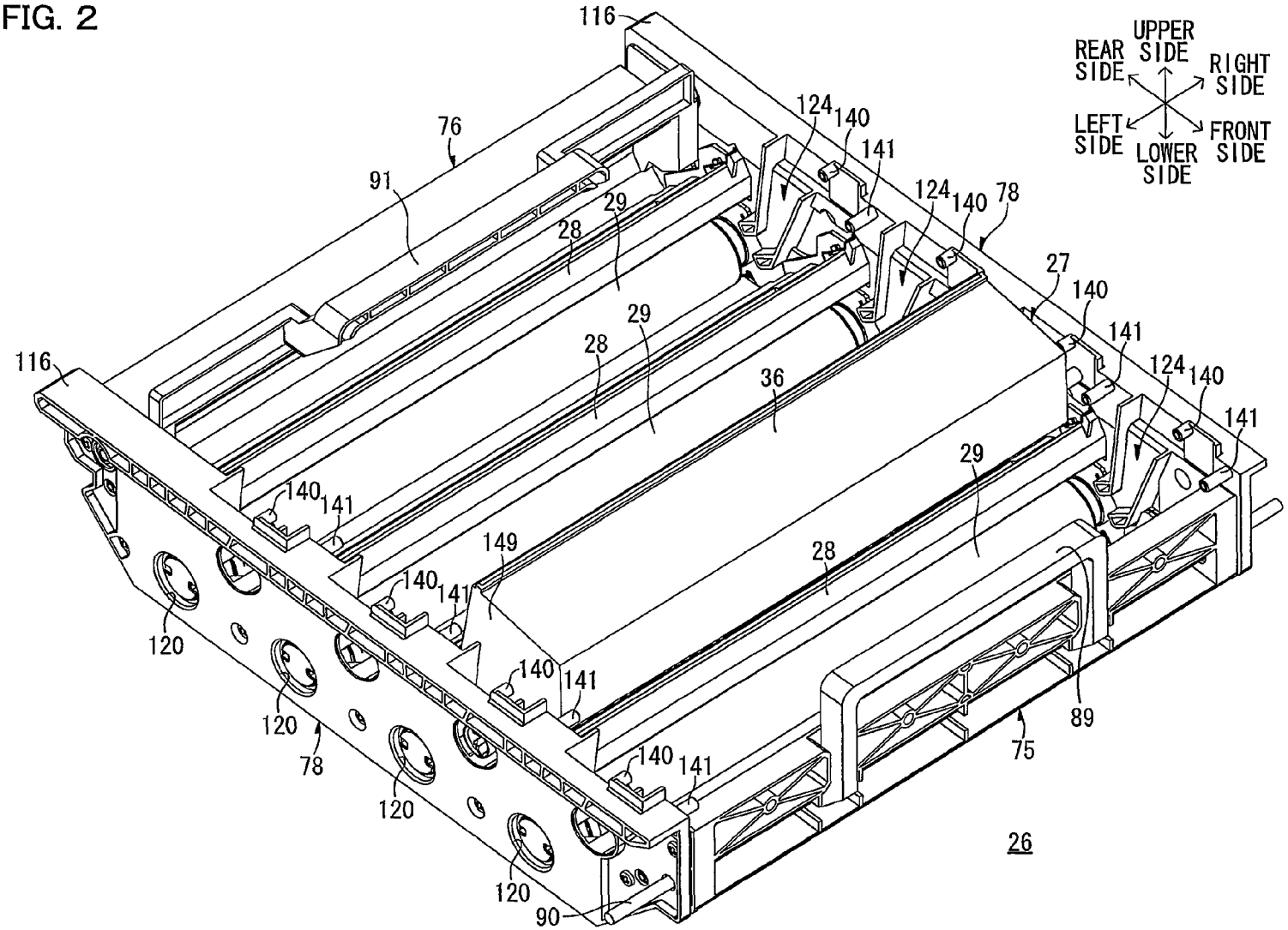
FIG. 2 is a perspective view of a drum unit shown in FIG. 1 as viewed from above the left front side, in a state where one of developer cartridges is mounted while the remaining developer cartridges are detached.
Figure 3:
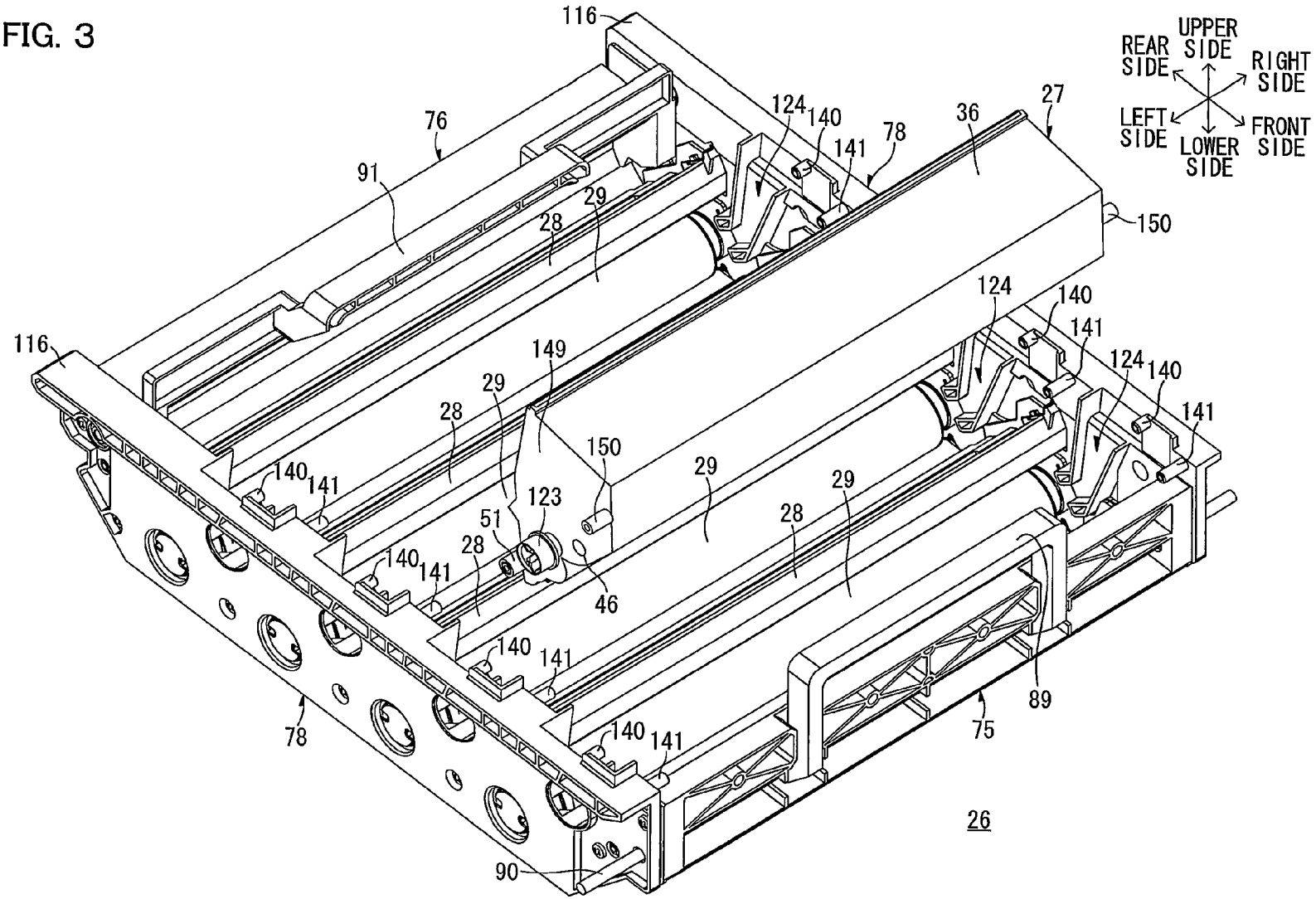
FIG. 3 is a perspective view of the drum unit as viewed from above the left front side, in a state where one of the developer cartridges is in the process of mounting/detachment while the remaining developer cartridges are detached.
Figure 4:
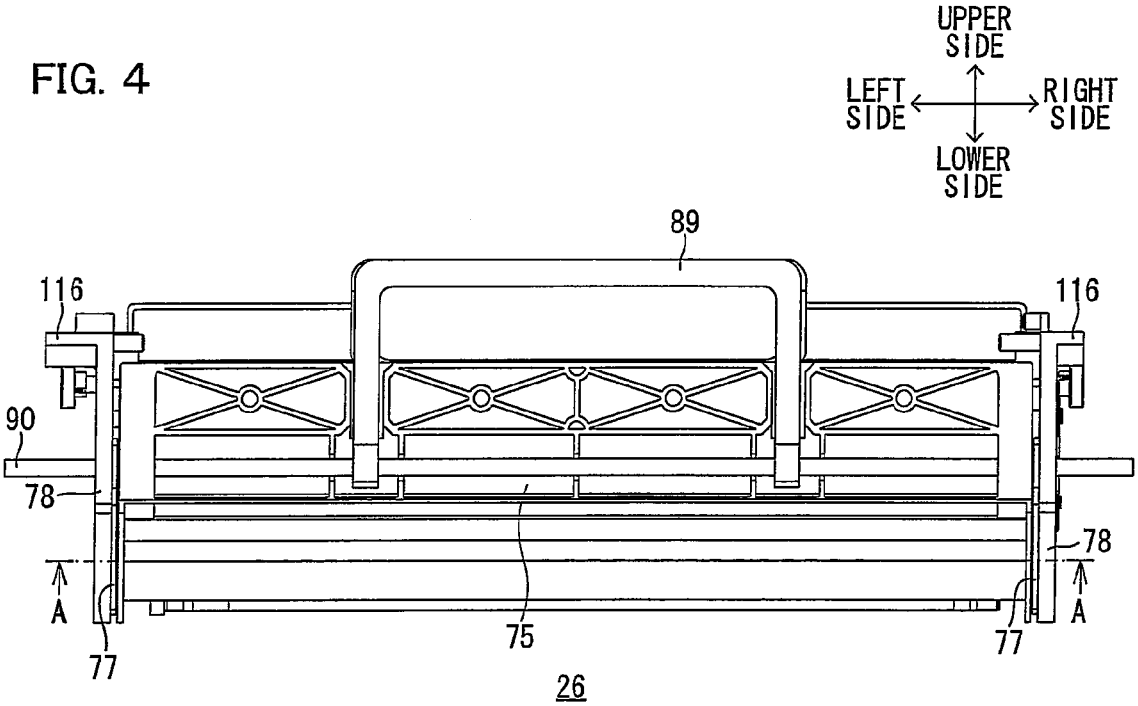
FIG. 4 is a front elevational view of the drum unit.
Figure 5:
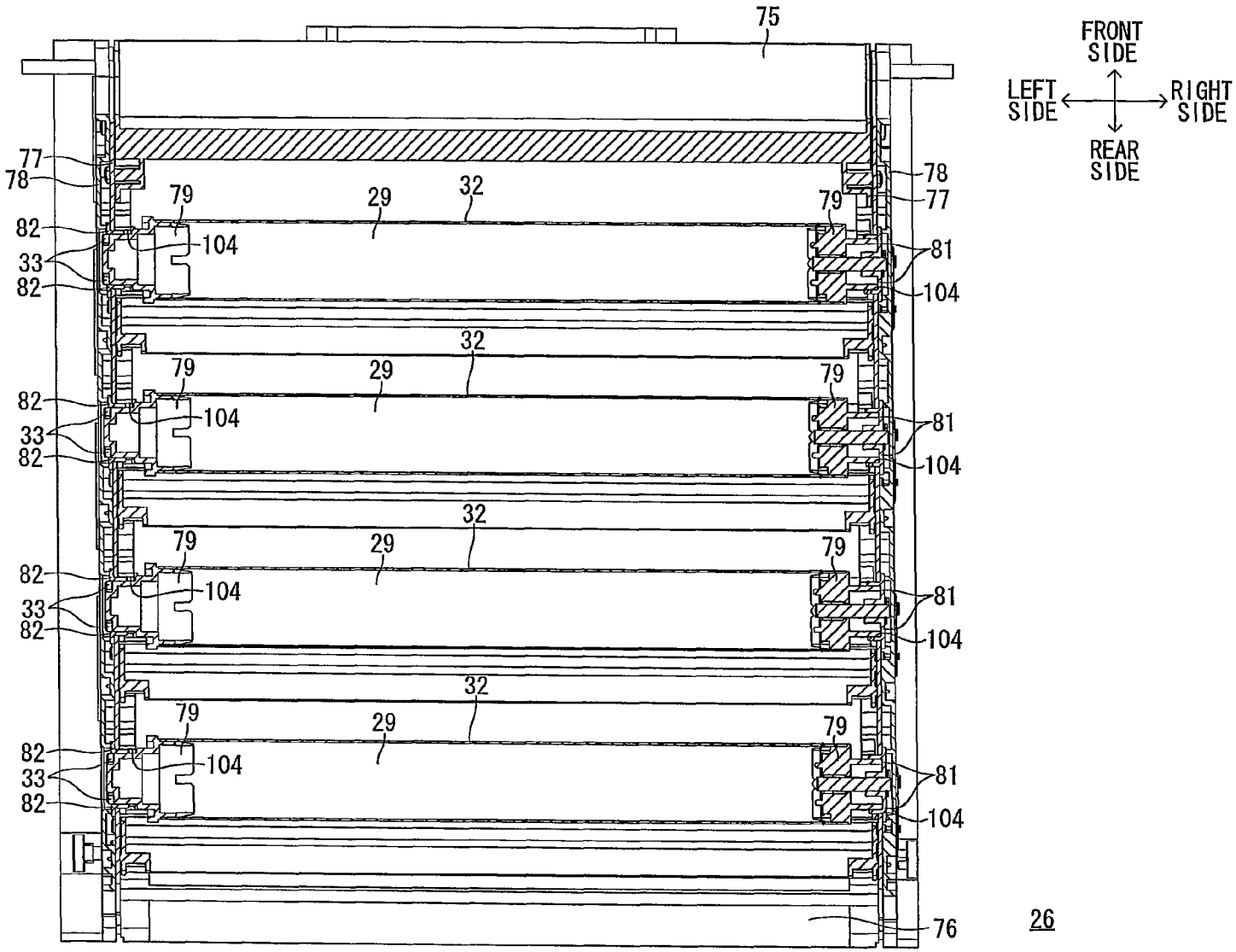
FIG. 5 is a sectional view of the drum unit taken along the line A-A in FIG. 4.
Figure 6:
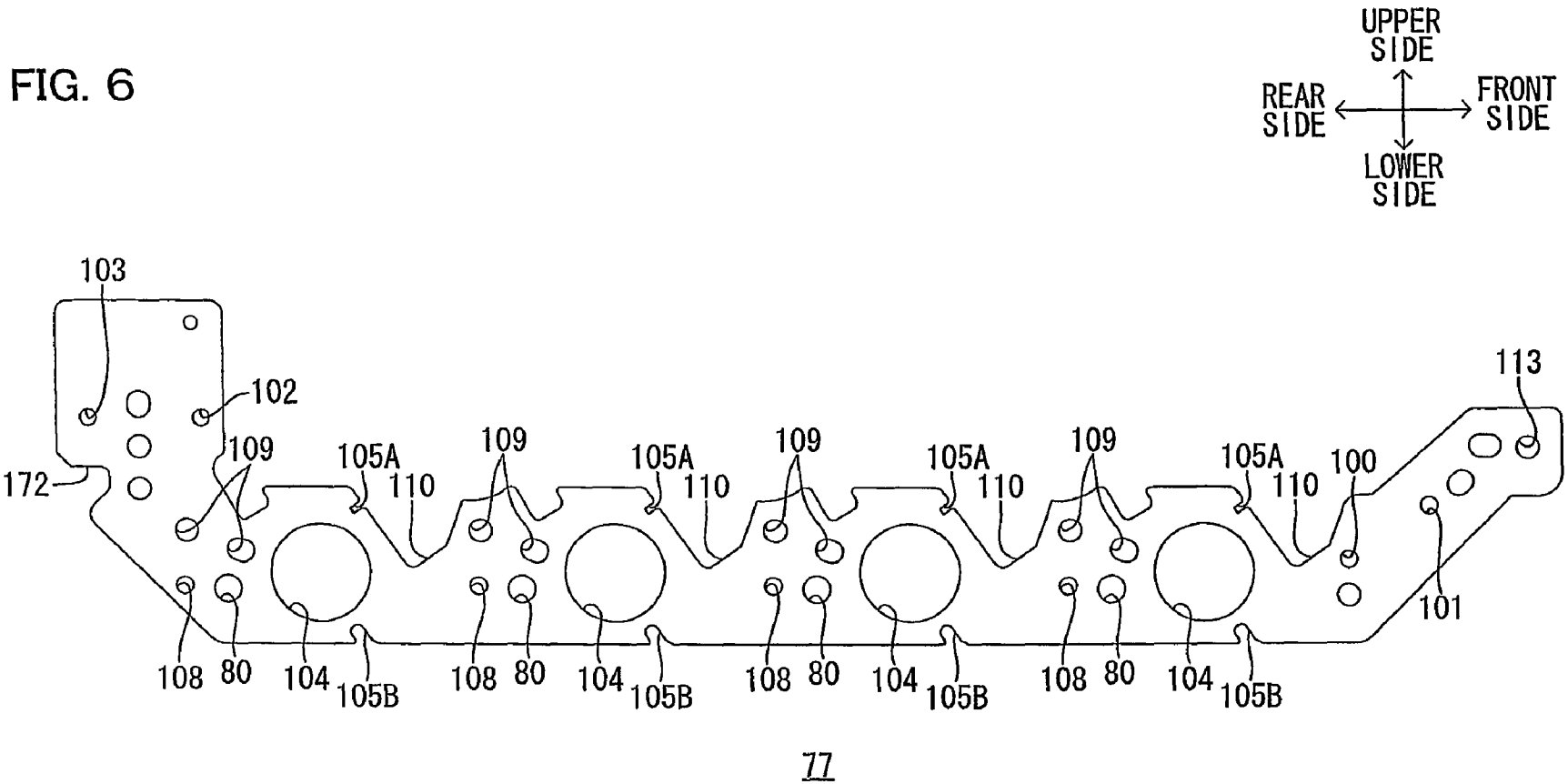
FIG. 6 is a right side elevational view of a first side plate shown in FIG. 4.
Figure 7A:
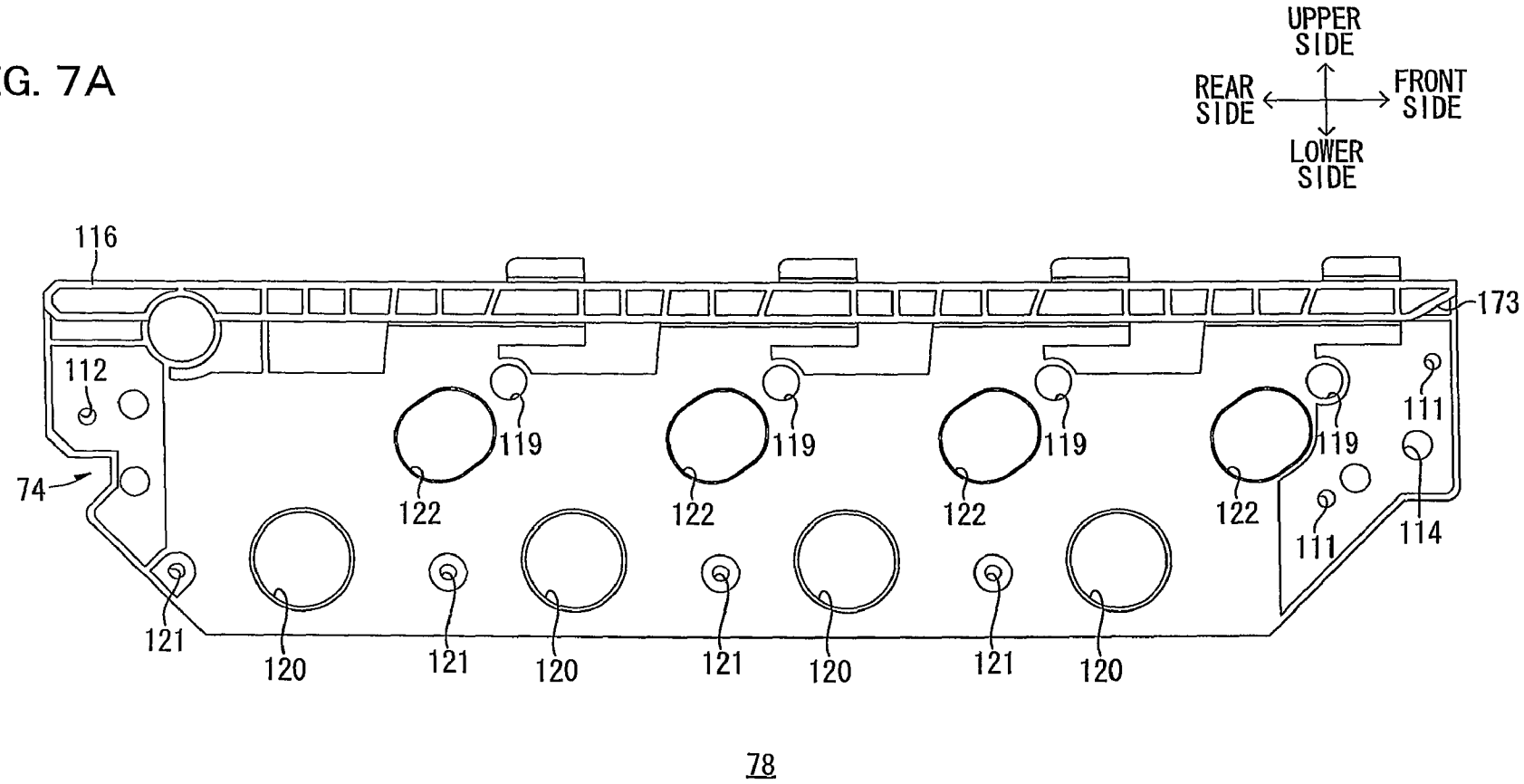
FIG. 7A is a left side elevational view of a left second side plate shown in FIG. 2.
Figure 7B:
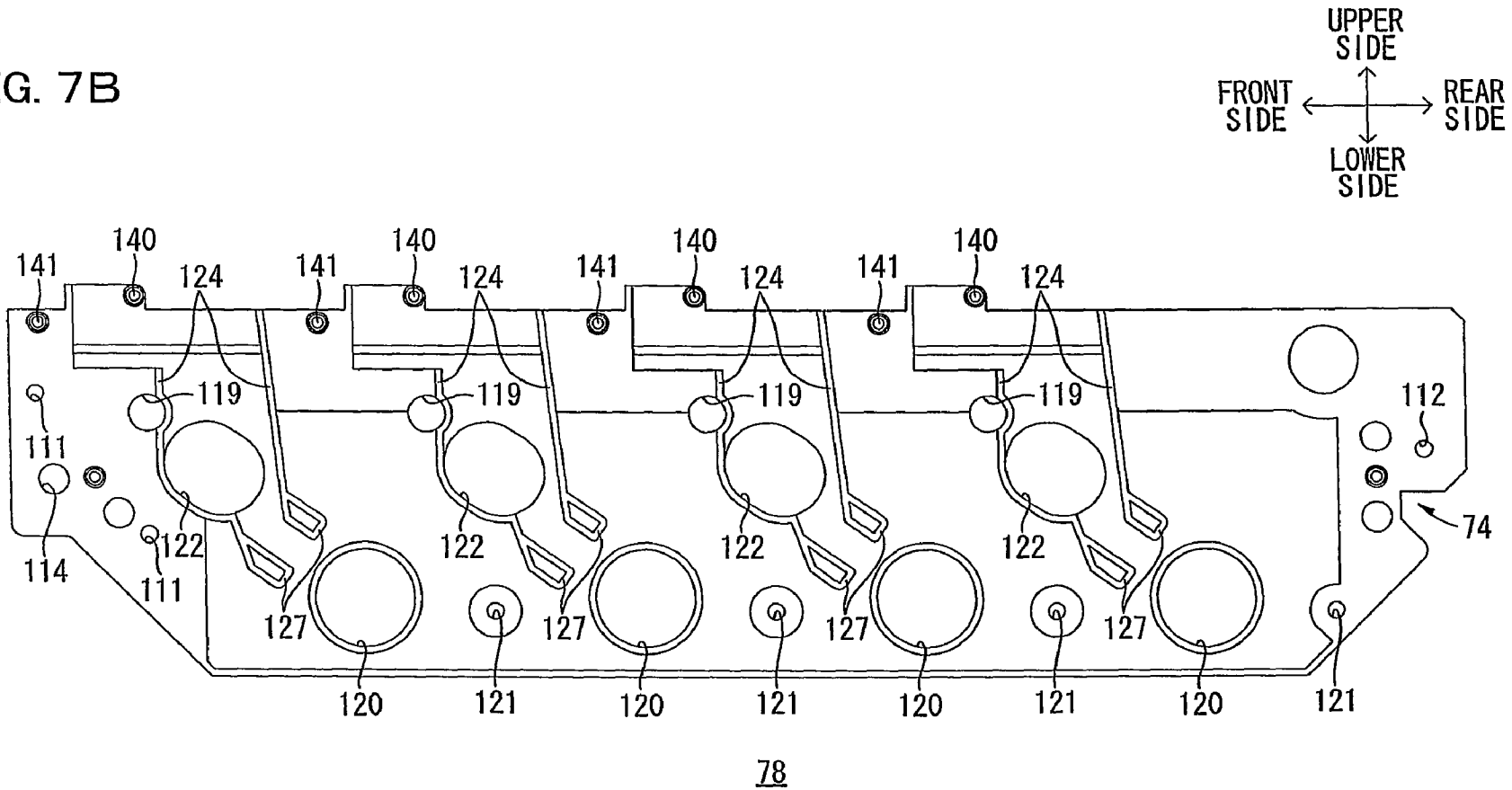
FIG. 7B is a right side elevational view of the left second side plate.
Figure 8A:
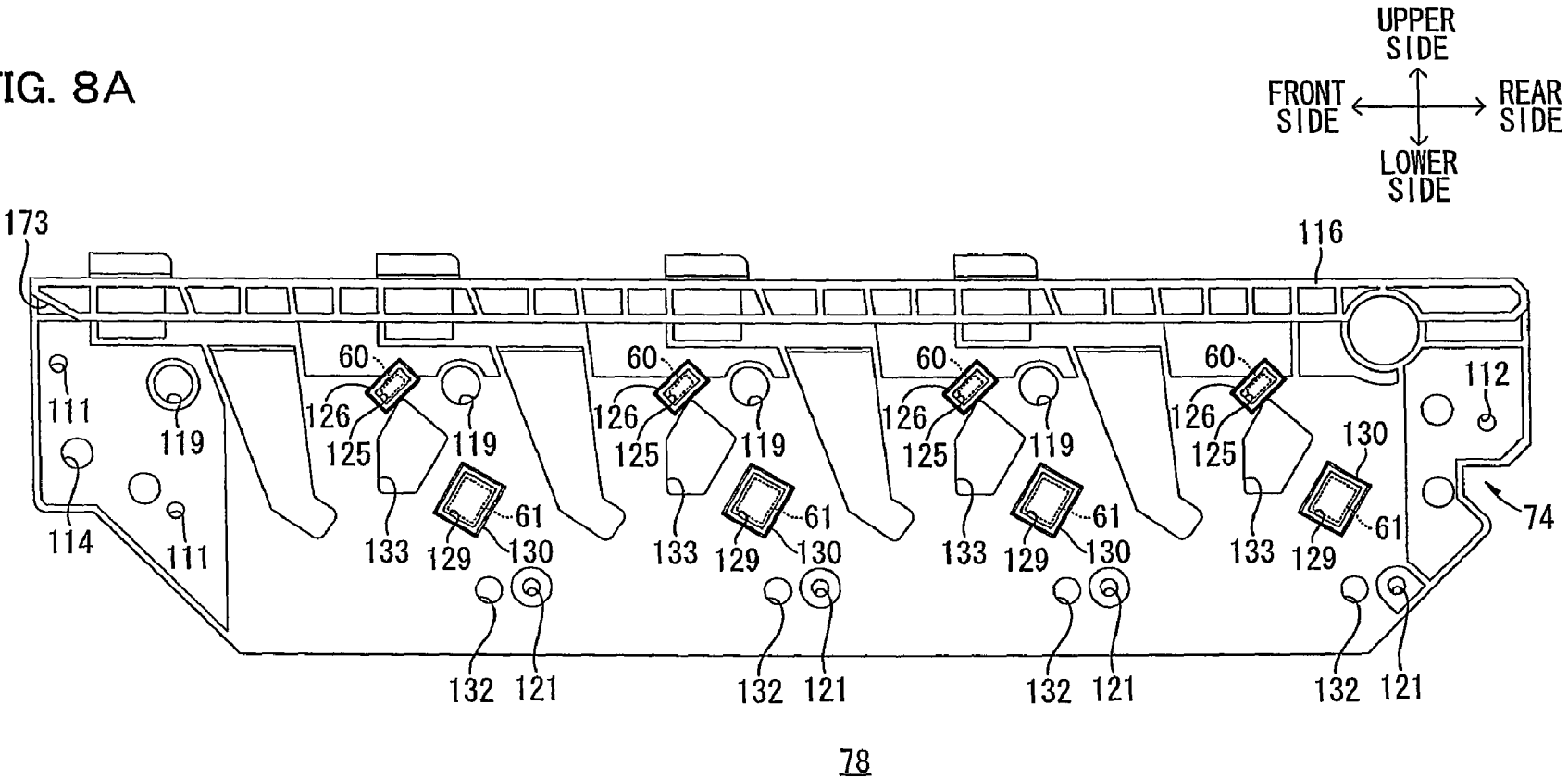
FIG. 8A is a right side elevational view of a right second side plate shown in FIG. 2.
Figure 8B:
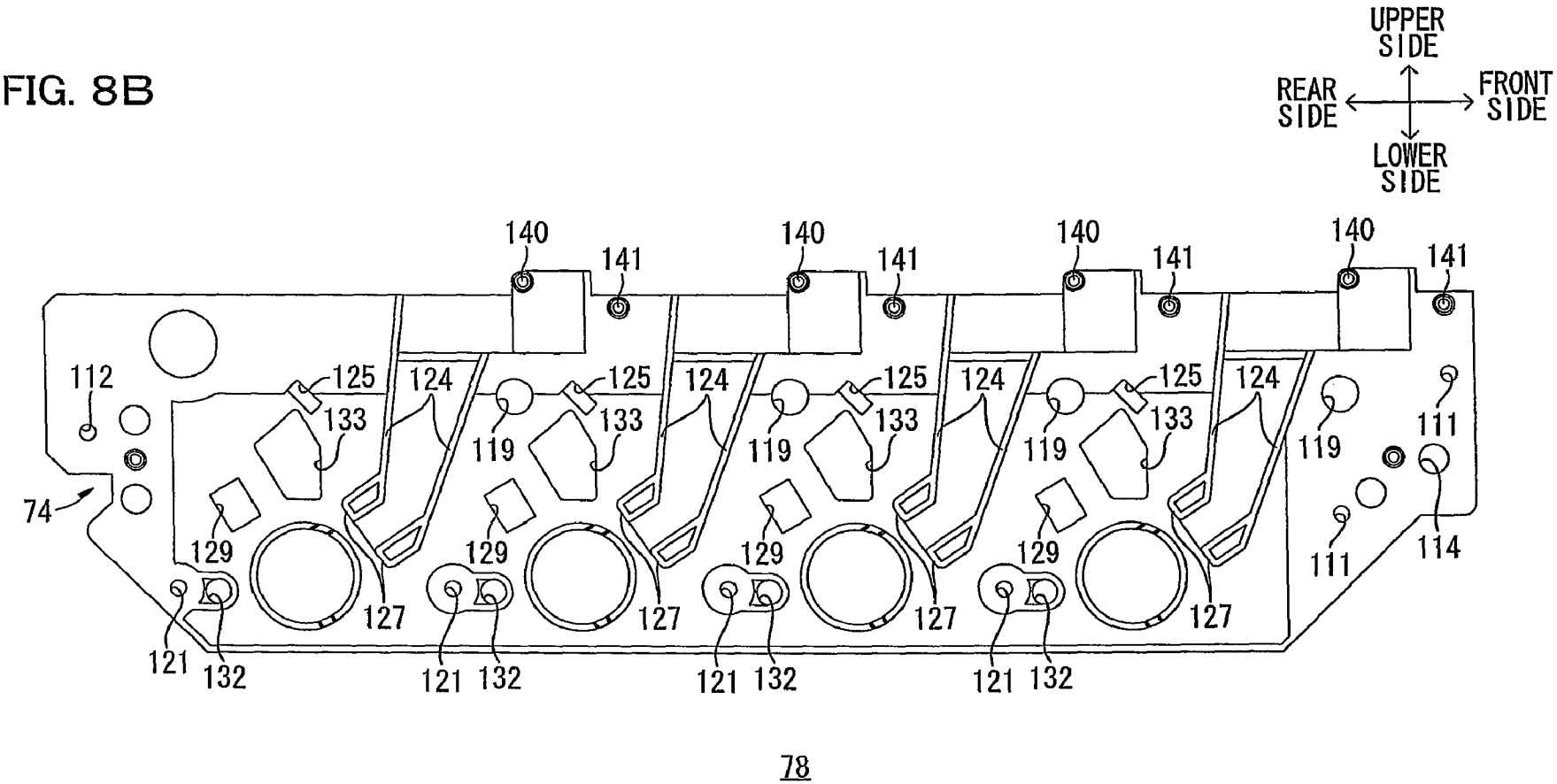
FIG. 8B is a left side elevational view of the right second side plate.
Figure 9:
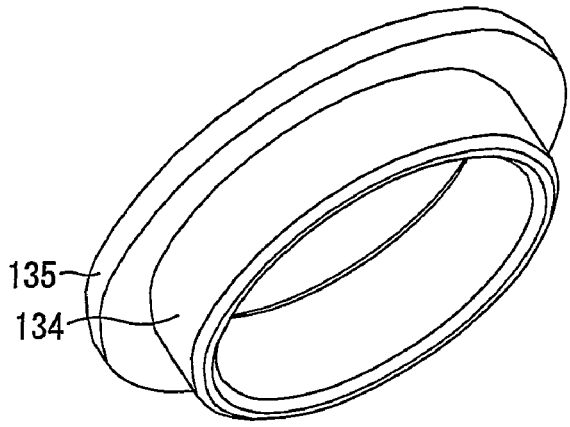
FIG. 9 is a perspective view of a left shaft receiving member shown in FIG. 5.
Figure 10:
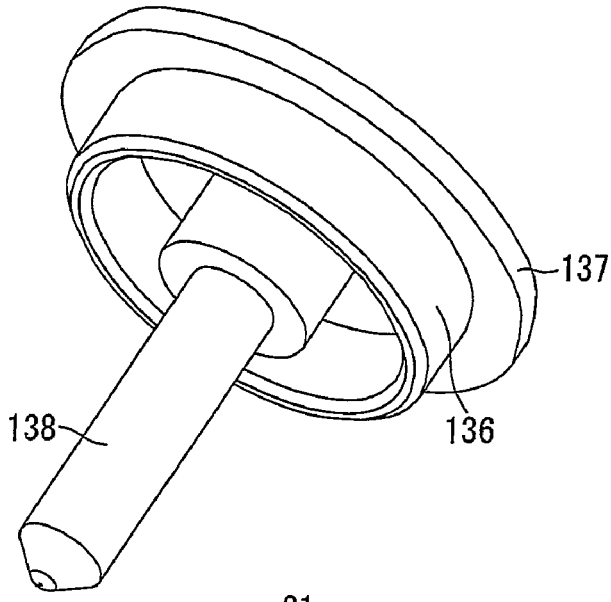
FIG. 10 is a perspective view of a right shaft receiving member shown in FIG. 5.
Figure 11A:
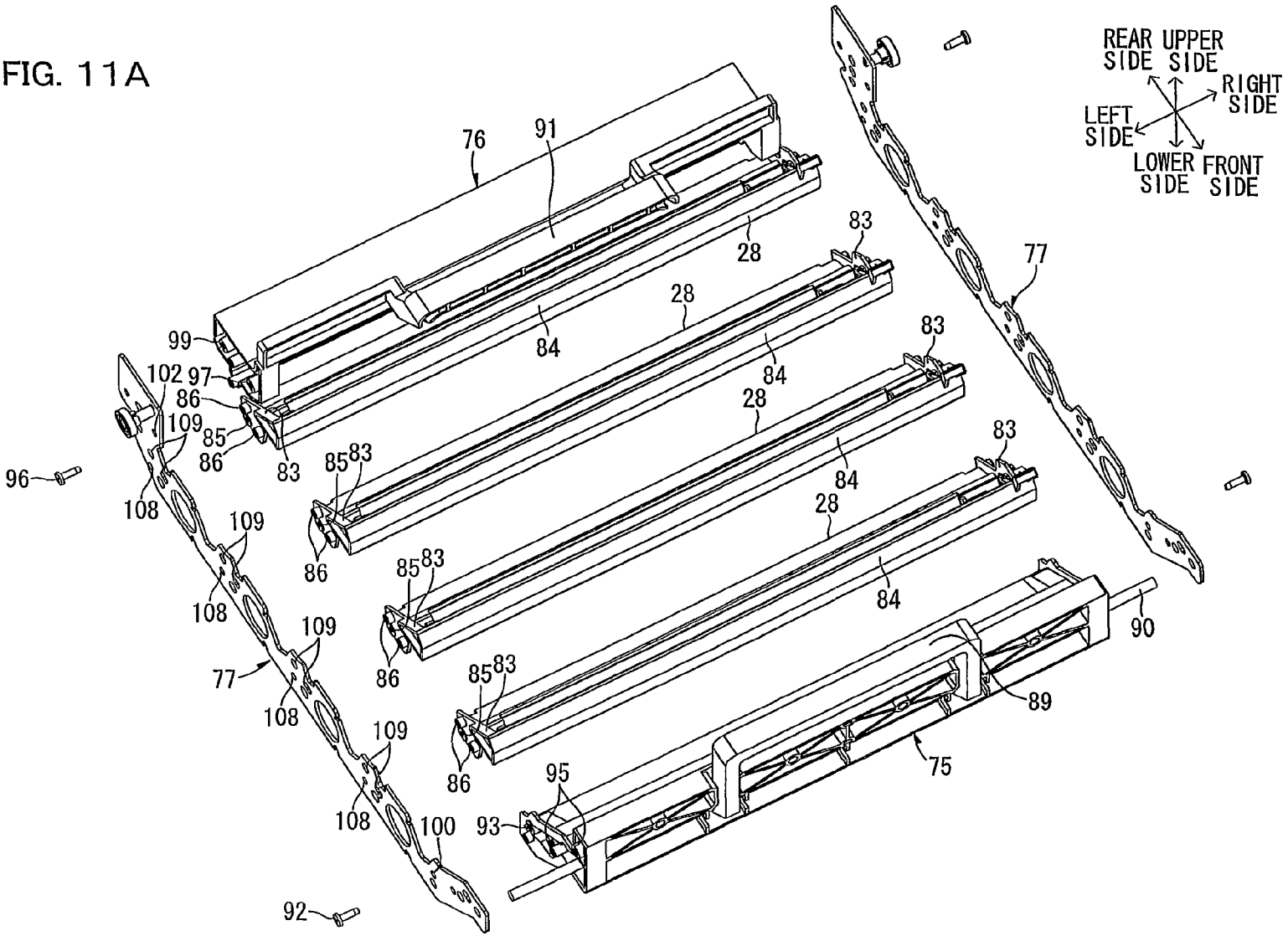
FIG. 11A is a perspective view of a front beam, four drum subunits, a rear beam and a pair of first side plates shown in FIG. 3 as viewed from above the left front side, in a state to be combined with one another.
Figure 11B:
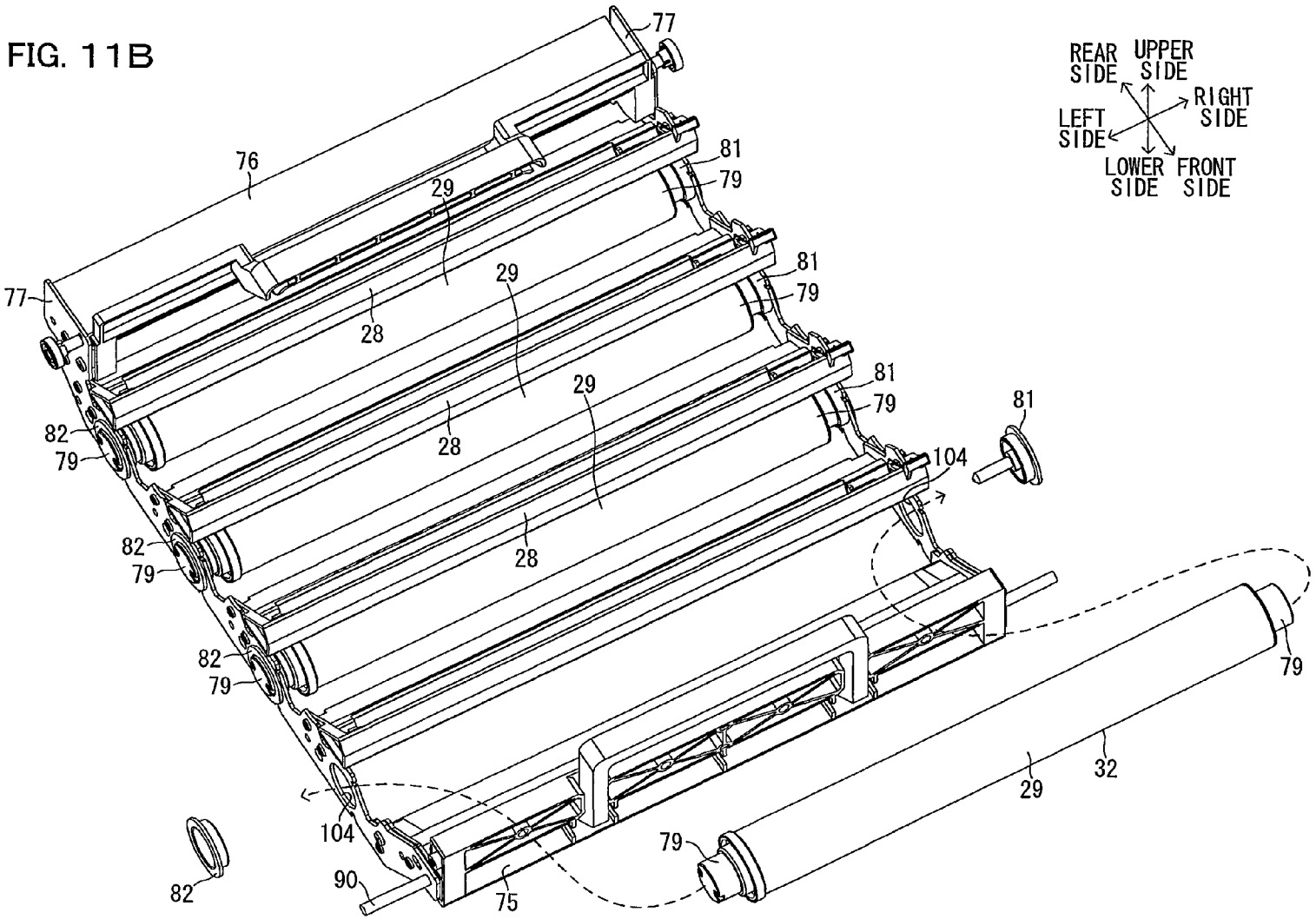
FIG. 11B is a perspective view as viewed from above the left front side for illustrating a state of combining photosensitive drums with the pair of first side plates.
Figure 11C:
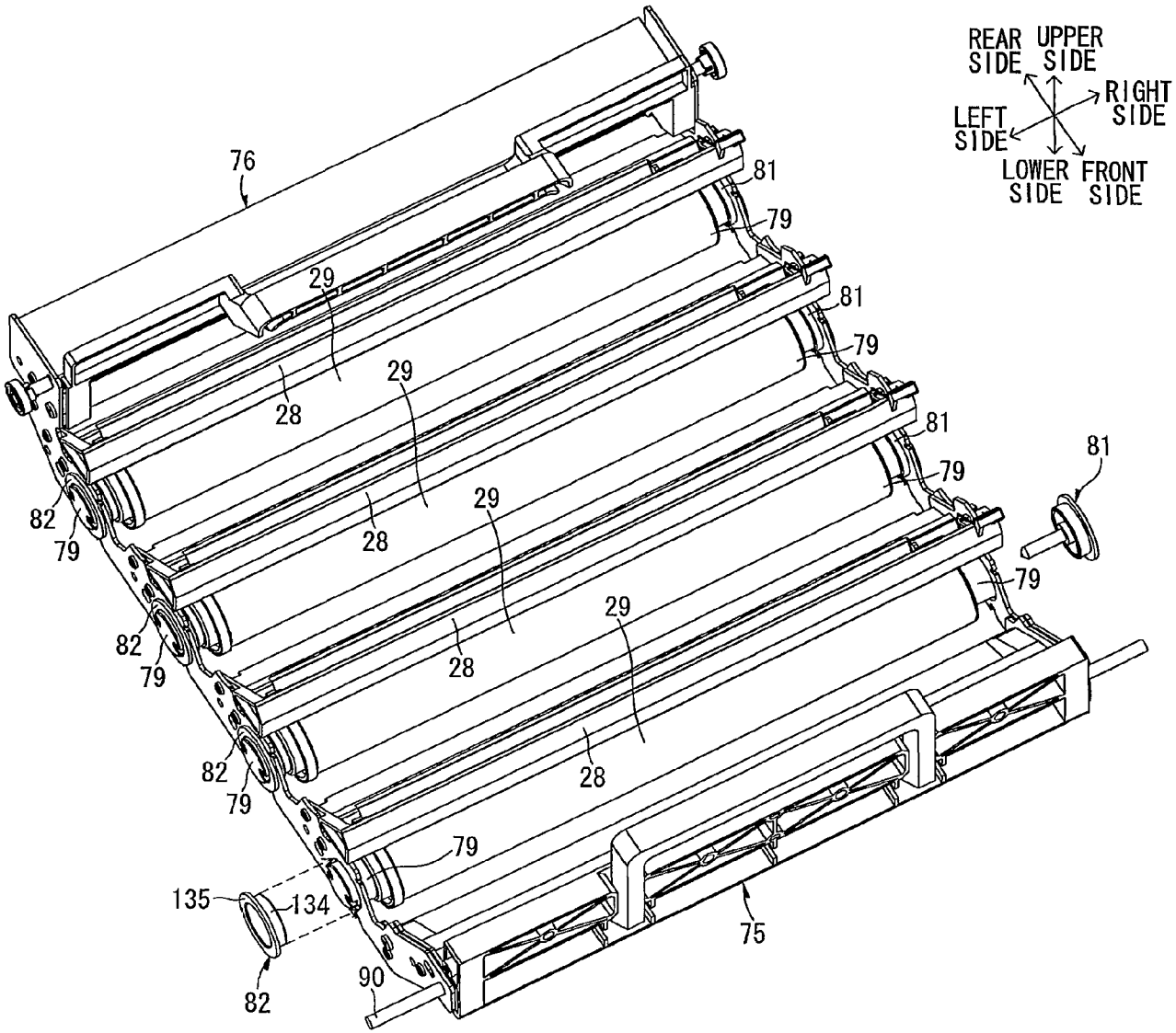
FIG. 11C is a perspective view as viewed from above the left front side for illustrating a state, subsequent to the state shown in FIG. 11B, of combining the photosensitive drums with the pair of first side plates.
Figure 11D:
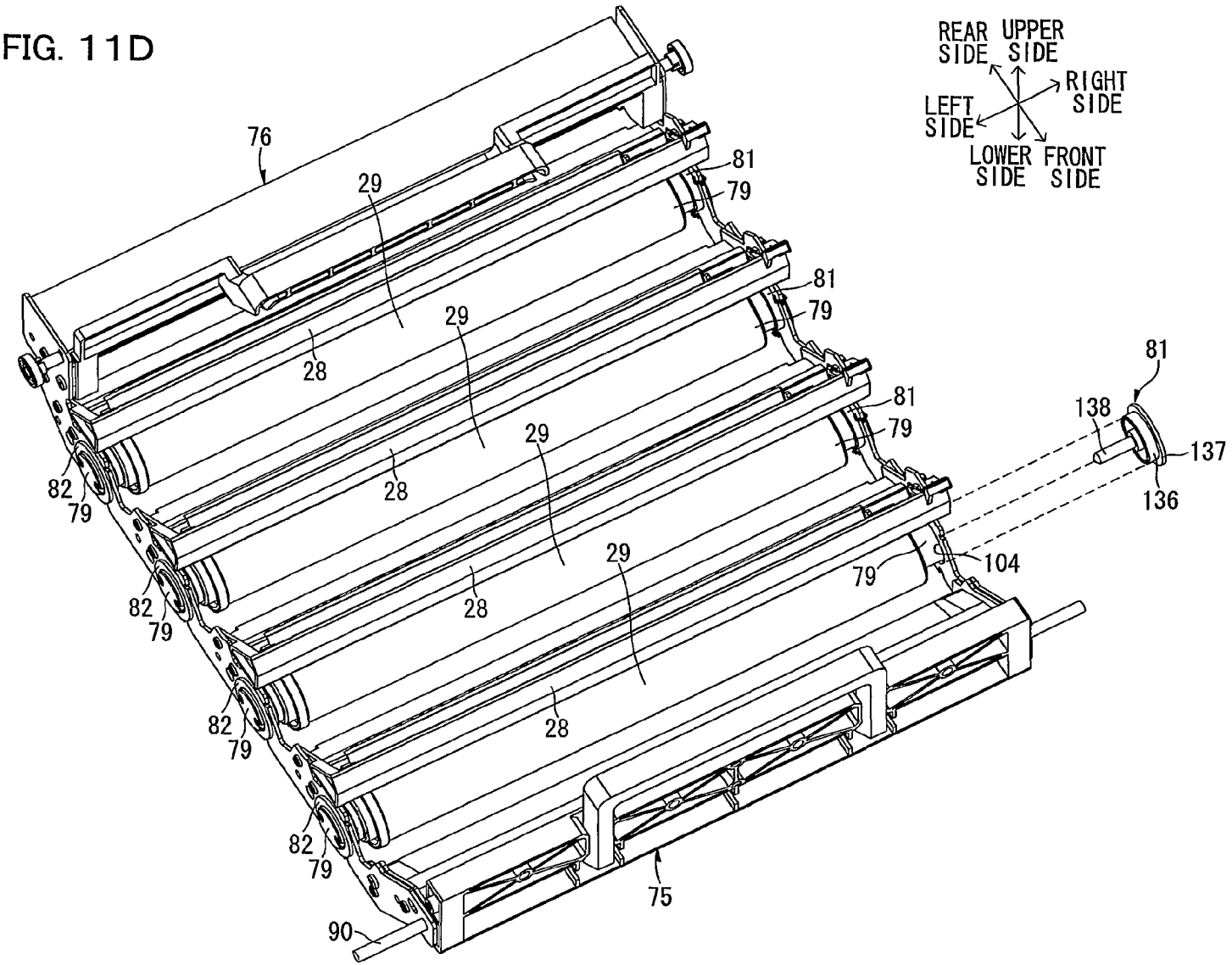
FIG. 11D is a perspective view as viewed from above the left front side for illustrating a state, subsequent to the state shown in FIG. 11C, of combining the photosensitive drums with the pair of first side plates.
Figure 11E:
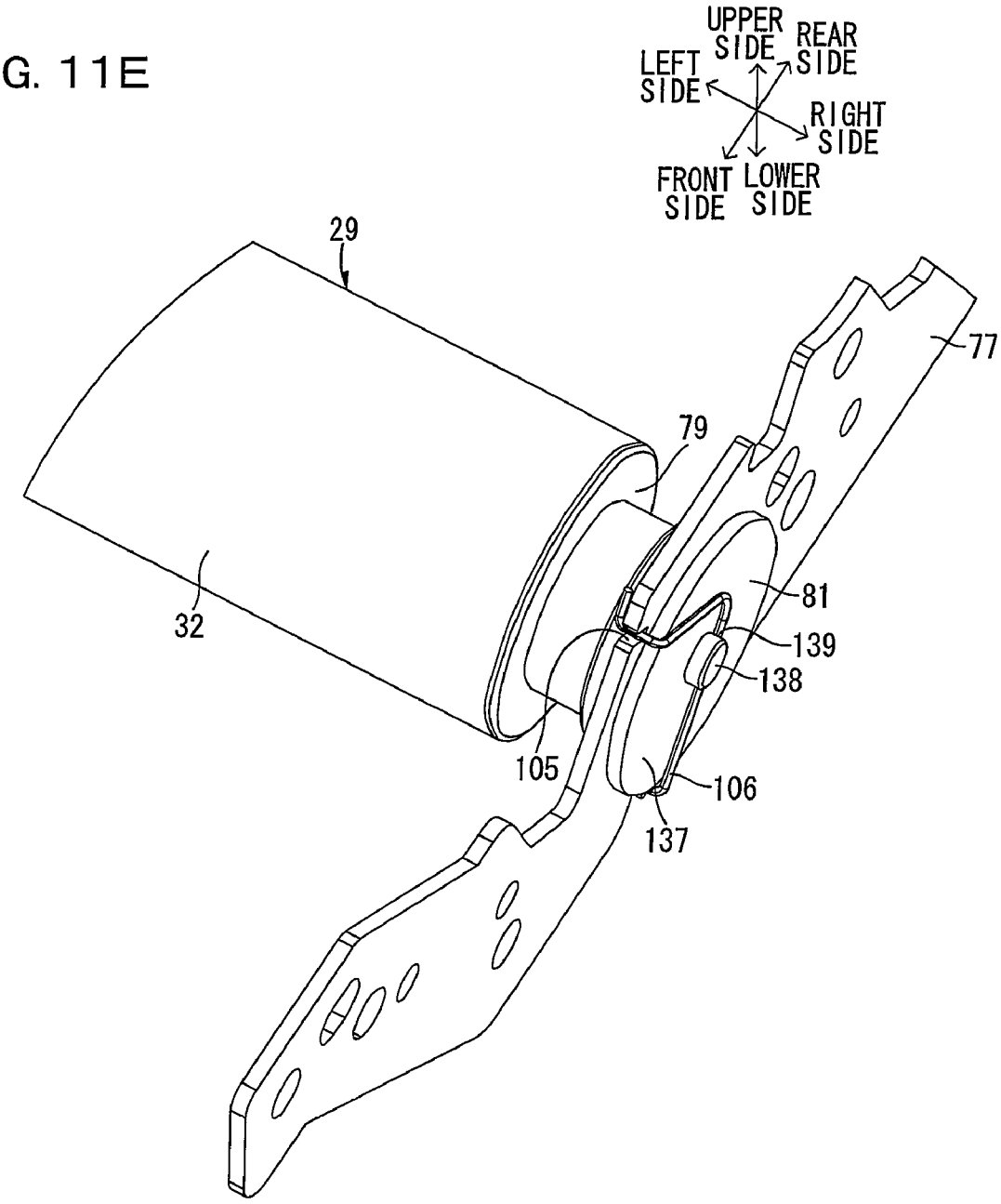
FIG. 11E is a perspective view showing a state where the right shaft receiving member is engaged with the corresponding first side plate.
Figure 11F:
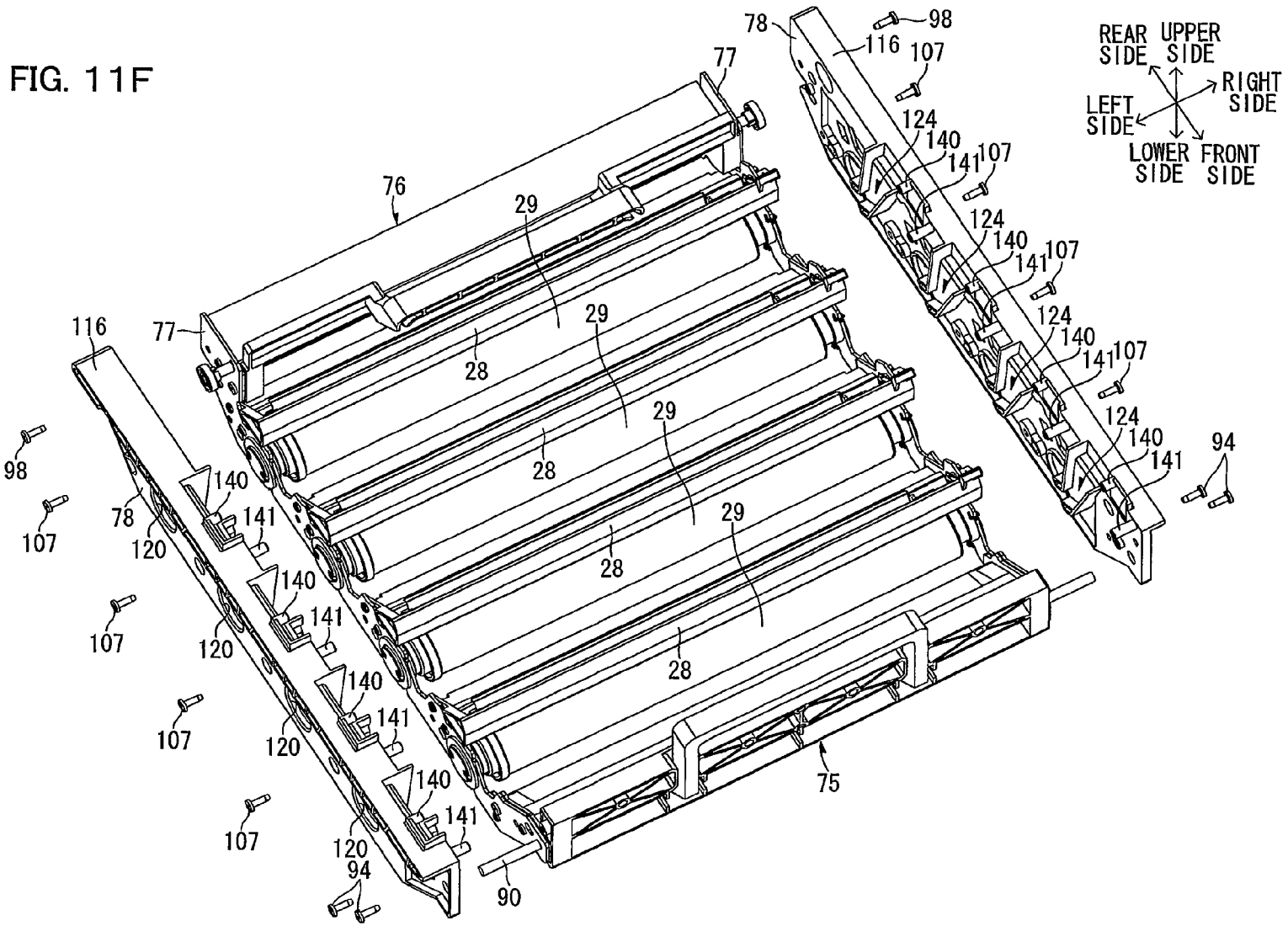
FIG. 11F is a perspective view as viewed from above the left front side showing a state of combining the right and left second side plates with the pair of first side plates.

FIG. 2 is a perspective view of the drum unit as viewed from above the left front side, in a state where one of the developer cartridges is mounted while the remaining developer cartridges are detached. FIG. 3 is a perspective view of the drum unit as viewed from above the left front side, in a state where one of the developer cartridges is in the process of mounting/detachment while the remaining developer cartridges are detached. FIG. 4 is a front elevational view of the drum unit. FIG. 5 is a sectional view of the drum unit taken along the line A-A in FIG. 4. FIG. 6 is a left side elevational view of a first side plate. FIG. 7A is a left side elevational view of a left second side plate. FIG. 7B is a right side elevational view of the left second side plate. FIG. 8A is a right side elevational view of a right second side plate. FIG. 8B is a left side elevational view of the right second side plate. FIG. 9 is a perspective view of a left shaft receiving member. FIG. 10 is a perspective view of a right shaft receiving member. FIG. 11A is a perspective view of a front beam, the four drum subunits, a rear beam and a pair of first side plates as viewed from above the left front side, in a state to be combined with one another. FIGS. 11B to 11D are perspective views as viewed from above the left front side for illustrating a state of combining the photosensitive drums with the pair of first side plates, FIG. 11E is a perspective view showing a state where the right shaft receiving member is engaged with the corresponding first side plate, and FIG. 11F is a perspective view as viewed from above the left front side showing a state of combining the right and left second side plates with the pair of first side plates.

The drum unit 26 includes a front beam 75, a rear beam 76, a pair of right and left first side plates 77 (see FIG. 5) and a pair of right and left second side plates 78 in addition to the four photosensitive drums 29, the four drum subunits 28 and the four developer cartridges 27, as shown in FIG. 3.

In the drum unit 26, the four photosensitive drums 29, the four drum subunits 28, the four developer cartridges 27, the front beam 75, the rear beam 76, the pair of first side plates 77 and the pair of second side plates 78 are slidably mounted in/detached from the main body casing 2 (see FIG. 1).

(1) Drum Subunit

Each drum subunit 28 includes a pair of side frames 83 opposed to each other at an interval in the width direction and a center frame 84 extended between the side frames 83, as shown in FIG. 11A.

Each side frame 83 is made of resin, and in the form of a generally triangular plate in side elevational view. A threaded portion 85 is formed on the rear lower end portion of the side frame 83. The side frame 83 is provided with cylindrical bosses 86 formed on a position above the threaded portion 85 and a position in front of this position to protrude outward in the width direction respectively.

The center frame 84 is made of resin, and in the form of a rectangle elongated in the width direction in plan view. The center frame 84 retains the scorotron charger 30 and the cleaning brush 31 for cleaning the surface of the corresponding photosensitive drum 5, as shown in FIG. 1. The pair of side frames 83 and the center frame 84 are integrally molded.

(2) Front Beam

The front beam 75 is made of resin. As shown in FIGS. 3 and 5, the front beam 75 is arranged in front of the four drum subunits 28 and the four photosensitive drums 29, and extended between the pair of first side plates 77.

The front beam 75 retains a support shaft 90. The support shaft 90 is so arranged as to pass through the front beam 75 along the width direction. Both ends of the support shaft 90 protrude outward from the front beam 75 in the width direction, and further pass through the first and second side plates 77 and 78 to protrude outward in the width direction.

The support shaft 90 rotatably supports a front-side grasp portion 89, which is arranged at a central portion of the front beam 75 in the width direction. The front-side grasp portion 89 is generally U-shaped. Free end portions of the front-side grasp portion 89 are rotatably supported by the support shaft 90, so that the front-side grasp portion 89 is swingable between an accommodated position upright along the front beam 75 and an operating position inclined frontward from the front beam 75.

On each side surface of the front beam 75 in the width direction, a first threaded portion 93 is formed on a rear lower end portion, as shown in FIG. 11A. On each side surface of the front beam 75 in the width direction, further, second threaded portions 95 are formed on a central portion and a front upper position respectively.

(3) Rear Beam

The rear beam 76 is made of resin. The rear beam 76 is arranged at the back of the four drum subunits 28 and the four photosensitive drums 29 and extended between the pair of first side plates 77, as shown in FIGS. 3 and 5.

A back-side grasp portion 91 is integrally formed on a central portion of the rear beam 76 in the width direction. The back-side grasp portion 91 is generally U-shaped in rear elevational view. Free end portions of the back-side grasp portion 91 are coupled to the rear beam 76, so that the back-side grasp portion 91 is inclined from a rear lower side toward a front upper side, to protrude obliquely upward from the rear beam 76.

On each side surface of the rear beam 76 in the width direction, a first threaded portion 97 is formed on a front upper end portion, as shown in FIG. 11A. On each side surface of the rear beam 76 in the width direction, further, a second threaded portion 99 is formed on a rear end portion.

(4) First Side Plate

The right and left first side plates 77 are prepared by press-working metallic plates with the same press die, to have the same shapes.

Each first side plate 77 is generally in the form of an elongated rectangular plate extending in the anteroposterior direction, as shown in FIG. 6. The front and rear end portions of the first side plates 77 are opposed to the front beam 75 and the rear beam 76 respectively, as shown in FIG. 11B.

The front end portion of each first side plate 77 extends from a rear lower side toward a front upper side. In the front end portion of each first side plate 77, a first penetration hole 100 is formed on a position opposed to the corresponding first threaded portion 93 of the front beam 75. In the front end portion of each first side plate 77, further, a second penetration hole 101 is formed on a position opposed to the corresponding second threaded portion 95 of the front beam 75. In addition, a support shaft insertion hole 113 receiving the support shaft 90 is formed on the front end portion of each first side plate 77.

The rear end portion of each first side plate 77 is generally L-shaped inside elevational view. More specifically, the rear end portion of each first side plate 77 is inclined toward a rear upper side, to further extend upward. In the rear end portion of each first side plate 77, a third penetration hole 102 is formed on a position opposed to the corresponding first threaded portion 97 of the rear beam 76. In the rear end portion of each first side plate 77, further, a fourth penetration hole 103 is formed on a position opposed to the corresponding second threaded portion 99 of the rear beam 76.

Four circular drum retaining holes 104 are formed on each first side plate 77. The drum retaining holes 104 are formed between the front and rear end portions of each first side plate 77 at regular intervals from one another in the anteroposterior direction.

Developer receiving grooves 110 generally V-shaped in side elevational view are formed in each first side plate 77 on positions above the front upper sides of the drum retaining holes 104 by notching upper edge portions of the first side plate 77 generally triangularly in side elevational view respectively. The developer receiving grooves 110 are so formed as not to interfere with the lower end portions of the casings 36 of the developer cartridges 27.

An engaging groove 105A is formed on the rear end portion of each developer receiving groove 110. Ends of clip members 106 (see FIG. 11E) described later are engaged with the engaging grooves 105A respectively. On the lower end portion of each first side plate 77, other engaging grooves 105B are formed under each engaging grooves 105A respectively. The other end of the clip member 106 is engaged with the corresponding engaging groove 105B.

In each first side plate 77, a fifth penetration hole 108 is formed at the back of each drum retaining hole 104 on a position opposed to the threaded portion 85 of each side frame 83. Each first side plate 77 is further provided with boss holes 109 receiving the bosses 86 of each side frame 83 and erasing light passing holes 80 for passing erasing light. Each erasing light passing hole 80 is arranged between the drum retaining hole 104 and the fifth penetration hole 108 respectively.

(5) Second Side Plate

Each second side plate 78 is made of fiber-reinforced resin, for example. Each second side plate 78 is generally in the form of an elongated rectangular plate in side elevational view, vertically wider than and anteroposteriorly generally identical in length to the first side plate 77 (see FIG. 6), as shown in FIGS. 7A, 7B, 8A and 8B. The front and rear end portions of each second side plate 78 are opposed to the front and rear beams 75 and 76 respectively, as shown in FIG. 2.

A flange portion 116 as an example of a guided portion extending outward in the width direction is formed on the upper end portion of each second side plate 78 over the anteroposterior direction. This flange portion 116 slidably comes into contact with a roller member 118, provided on each main body side plate 117 described later as an example of a unit guide portion, from above. An inclined surface 173 inclined from the lower surface toward a front upper side is formed on the front end portion of the flange portion 116.

Each second side plate 78 is further provided with detection light passing holes 119 opposed to the detection windows 46 (see FIG. 1) of the developer cartridges 27 respectively when the developer cartridges 27 are mounted between the right and left second side plates 78.

Each second side plate 78 is further provided with first screw insertion holes 121 for receiving screws 107 on positions opposed to the threaded portions 85 of the drum subunits 28 respectively.

The front end portion of each second side plate 78 is formed narrower in the vertical direction than an intermediate portion thereof. The lower edge of the front end portion of each second side plate 78 is inclined toward a front upper side. In the front end portion of each second side plate 78, second screw insertion holes 111 are formed on positions opposed to the second threaded portions 95 of the front beam 75 respectively. A support shaft insertion hole 114 receiving the support shaft 90 is further formed on the front end portion of each second side plate 78.

The rear end portion of each second side plate 78 is also formed narrower in the vertical direction than the intermediate portion thereof. The lower edge of the rear end portion of each second side plate 78 is inclined toward a rear upper side. In the rear end portion of each second side plate 78, a third screw insertion hole 112 is formed on a position opposed to the corresponding second threaded portion 99 of the rear beam 76.

A notched portion 74 is formed on the rear end portion of each second side plate 78 by notching the lower edge of the notched portion 74 in a generally V-shaped manner. More specifically, the notched portion 74 has an upper edge extending in the anteroposterior direction in side elevational view, a lower edge inclined toward a front upper side with a constant gradient and a front edge coupling the front ends of the upper and lower edges with each other. Also in the rear end portion of each first side plate 77, a notched portion 172 (see FIG. 6) is formed on a position overlapping with the corresponding notched portion 74 of the second side plate 78 when the drum unit 26 is assembled. The notched portion 172 is generally identical in shape to the notched portion 74, while the front and lower edges thereof are positioned rearward beyond those of the notched portion 74. When the drum unit 26 is mounted in the main body casing 2, the notched portions 172 receive a main body reference shaft 115 (described later) provided on the main body casing 2, and come into contact with the main body reference shaft 115 from upper and front sides. When the drum unit 26 is mounted in the main body casing 2, the notched portions 74 do not interfere with the main body reference shaft 115.

On the inner surface (the right side surface of the left second side plate 78 or the left side surface of the right second side plate 78) of each second side plate 78 in the width direction, four cartridge guide portions 124 for guiding mounting/detachment of the developer cartridges 27 with respect to the right and left second side plates 78 are formed at regular intervals in the anteroposterior direction. Each cartridge guide portion 124 is formed by two protrusions protruding inward in the width direction from the inner side surface of the second side plate 78 at an interval from each other. The cartridge guide portions 124 are inclined from the upper end portion of the second side plate 78 toward a rear lower side with a constant gradient, and coupled with cartridge retaining portions 127 respectively. Each cartridge retaining portion 127 is formed parallelly to a line connecting the center of each photosensitive drum 29 and the corresponding developing roller 39 with each other, while the lower end portion thereof is opened toward the mounting position of the photosensitive drum 29. The lower edge of the cartridge guide portion 124 is opposed to the corresponding developer receiving groove 110 of the first side plate 77 in the width direction.

On the upper end portion of the inner side surface of each second side plate 78, four first support shafts 140 are projectingly provided at regular intervals from one another in the anteroposterior direction. On the upper end portion of the inner side surface of each second side plate 78, further, four second support shafts 141 as examples of four support shafts are projectingly provided at regular intervals from one another in the anteroposterior direction. Each second support shaft 141 is arranged on a position separated frontward from each first support shaft 140. Each first support shafts 140 swingably support link levers 142 (see FIG. 13) described later, although not shown in FIGS. 7A to 8B. Each second support shafts 141 swingably support pressing members 143 (see FIG. 13) as examples of cartridge pressing members described later, although not shown in FIGS. 7A to 8B.

(5-1) Left Second Side Plate

The left second side plate 78 is provided with drum coupling insertion holes 120 exposing the left axial end portions of the photosensitive drums 29 respectively, as shown in FIG. 2.

Four such drum insertion holes 120 are formed on the lower end portion of the second side plate 78 at intervals from one another in the anteroposterior direction. Each drum coupling insertion hole 120 is formed as a round hole penetrating in the thickness direction on a position opposed to the axial left end portion of each photosensitive drum 29 and the corresponding drum retaining hole 104 provided on the first side plate 77 in the thickness direction. The drum coupling insertion holes 120 are opposed to four coupling gear (not shown) on the main body side respectively. The drum coupling insertion hole 120 has a diameter larger than the outer diameter of each flange member 79 and smaller than the outer diameter of the left shaft receiving member 82 described later. Thus, the drum coupling insertion hole 120 can prevent the corresponding left shaft receiving member 82 from dropping when the drum unit 26 is assembled.

In the left second side plate 78, a developer coupling insertion hole 122 is formed on an intermediate portion of each cartridge guide portion 124 in the vertical direction. When each developer cartridges 27 are mounted between the right and left second side plates 78, a coupling passive gear 123 (see FIG. 3) provided on the left side surface of the developer cartridge 27 is opposed to each developer coupling insertion hole 122.

(5-2) Right Second Side Plate

The right second side plate 78 is provided with four charge grid electrode openings 129, four charge wire electrode openings 125, four erasing light passing holes 132 and four air intakes 133 as examples of air passages as shown in FIGS. 8A and 8B. The right second side plate 78 is also provided with four developing electrode openings (not shown).

(5-2-1) Charge Grid Electrode Opening

Each charge grid electrode opening 129 is arranged at the back of the lower end portion of each cartridge guide portion 124. The charge grid electrode opening 129 is formed as a rectangular hole in side elevational view penetrating in the thickness direction on a position opposed to a charge grid electrode 61 as an example of a unit-side feeding member for feeding power to a grid electrode of the corresponding scorotron charger 30 (see FIG. 1), as shown by broken lines in FIG. 8A. Thus, the charge grid electrode 61 is exposed from each charge grid electrode opening 129.

A charge grid connecting guide portion 130 as an example of a frame-shaped connecting guide portion surrounding each charge grid electrode-opening 129 in side elevational view is provided on the right side surface of the right second side plate 78. The charge grid connecting guide portion 130 is in the form of a rib protruding rightward from the right side surface of the right second side plate 78. When the drum unit 26 is mounted in the main body casing 2, a main body-side charge grid contact (not shown) provided in the main body casing 2 is arranged in the charge grid electrode opening 129 over each charge grid connecting guide portion 130 in the process of this mounting. In other words, the main body-side charge grid contacts are guided into the charge grid electrode openings 129 by the charge grid connecting guide portions 130, to be connected to the charge grid electrode 61 respectively.

(5-2-2) Charge Wire Electrode Opening

Each charge wire electrode opening 125 is arranged above the upper end surface of the first side plate 77 at the back of the upper end portion of the corresponding cartridge guide portion 124 when the drum unit 26 is assembled. This charge wire electrode opening 125 is formed as a rectangular hole in side elevational view penetrating in the thickness direction on a position opposed to a charge wire electrode 60 as an example of a unit-side feeding member for feeding power to a wire electrode of the corresponding scorotron charger 30 (see FIG. 1), as shown by broken lines in FIG. 8A. Thus, the charge wire electrode 60 is exposed from each charge wire electrode opening 125.

A charge wire connecting guide portion 126 as an example of a frame-shaped connecting guide portion surrounding each charge wire electrode opening 125 in side elevational view is provided on the right side surface of the right second side plate 78. The charge wire connecting guide portion 126 is so formed as to protrude rightward from the right side surface of the right second side plate 78, and so inclined that the quantity of protrusion thereof is reduced as separated from the charge wire electrode opening 125 with reference to the apices facing the charge wire electrode opening 125. When the drum unit 26 is mounted in the main body casing 2, a main body-side charge wire contact (not shown) provided in the main body casing 2 is arranged in the charge wire electrode opening 125 over each charge wire connecting guide portion 126 in the process of this mounting. In other words, the main body-side charge wire contacts are guided into the charge wire electrode openings 125 by the charge wire connecting guide portions 126, to be connected to the charge wire electrode 60 respectively.

(5-2-3) Erasing Light Passing Hole

Each erasing light passing hole 132 is arranged obliquely under the rear side of each charge grid electrode opening 129. The erasing light passing hole 132 is formed as a round hole penetrating in the thickness direction on a position opposed to the corresponding erasing light passing hole 80 provided on the first side plate 77. Erasing lamps (not shown) are provided outside the drum unit 26. Erasing light emitted from each erasing lamp is so fed to the peripheral surface of each photosensitive drum 29 (drum body 32) through the corresponding erasing light passing holes 132 and 80 as to expose the peripheral surface of the photosensitive drum 29 and erase positive charge remaining on the peripheral surface of the photosensitive drum 29.

(5-2-4) Air Intake

Each air intake 133 is formed between each charge wire electrode opening 125 and each charge grid electrode opening 129. This air intake 133 is formed as a hole penetrating in the thickness direction on a position opposed to the corresponding scorotron charger 30 retained by the drum subunit 28. Air flowing into each air intake 133 is fed to each scorotron charger 30. Ozone generated from the scorotron chargers 30 may be discharged from the drum unit 26 through the air intakes 133.

(6) Photosensitive Drum

Each photosensitive drum 29 includes a cylindrical drum body 32 and two flange members 79 engaged with both end portions of the drum body 32 to be not relatively rotatable respectively, as shown in FIG. 5.

The outermost layer of the drum body 32 is formed by a positively chargeable photosensitive layer.

Each flange member 79 is made of resin. The flange members 79 are partially inserted into both end portions of the drum body 32. In the left flange member 79, passive grooves 33 are provided on the outer (left) end surface of the photosensitive drum 29 in the axial direction, so that driving force from a motor (not shown) provided in the main body casing 2 is transmitted thereto.

The right and left flange members 79 are supported by the right and left shaft receiving members 81 and 82 respectively, to be rotatable with respect to the first side plate 77.

(6-1) Left Shaft Receiving Member

Each left shaft receiving member 82 is made of resin. The left shaft receiving member 82 integrally includes a cylindrical portion 134 in the form of a cylinder and a flange portion 135 in the form of an annular plate spreading outward from one (left) peripheral edge of the cylindrical portion 134, as shown in FIG. 9.

The cylindrical portion 134 has an outer diameter generally identical to the inner peripheral surface of the corresponding drum retaining hole 104 formed on the first side plate 77 and an inner diameter generally identical to the outer peripheral surface of an end portion (flange member 79) of the corresponding photosensitive drum 29.

(6-2) Right Shaft Receiving Member

Each right shaft receiving member 81 is made of conductive resin. The right shaft receiving member 81 includes a cylindrical portion 136 in the form of a cylinder, a flange portion 137 in the form of a disc so formed as to block one side of the cylindrical portion 136 and an earth shaft 138 passing through the flange portion 137 in the thickness direction, as shown in FIG. 10.

The cylindrical portion 136 has an outer diameter generally identical to the inner peripheral surface of the corresponding drum retaining hole 104 formed on the first side plate 77 and an inner diameter generally identical to the outer peripheral surface of the end portion (flange member 79) of the corresponding photosensitive drum 29.

The flange portion 137 has an outer diameter larger than that of the cylindrical portion 136.

The earth shaft 138 extends along the central axis of the cylindrical portion 136. An end of the earth shaft 138 slightly protrudes from the surface of the flange portion 137 opposite to the side provided with the cylindrical portion 136, as shown in FIG. 1E. An engaging hole 139 passing through the earth shaft 138 in the diametral direction is formed on the protruding portion. The forward end portion of the other end of the earth shaft 138 is in the form of a circular cone.

(7) Assembling of Drum Unit

First, the four drum subunits 28 are arranged at the regular intervals in the anteroposterior direction, as shown in FIG. 11A.

Then, the front beam 75 is arranged in front of the headmost drum subunit 28 at an interval therefrom. Further, the rear beam 76 is arranged at the back of the rearmost drum subunit 28 at a slight interval therefrom.

Thereafter the first side plates 77 are arranged on both sides of the front beam 75, the four drum subunits 28 and the rear beam 76 in the width direction respectively. Then, the first side plates 77 are combined with the front beam 75, the four drum subunits 28 and the rear beam 76 through screws 92 and 96.

More specifically, each first side plate 77 is so arranged that each pair of boss holes 109 are opposed to the bosses 86 of each side frame 83 in the width direction. Then, each first side plate 77 is brought into contact with the outer side surface of each side frame 83 in the width direction. Thus, the bosses 86 are engaged with the corresponding boss holes 109 respectively. Further, the first penetration hole 100 is opposed to the first threaded portion 93 of the front beam 75, the third penetration hole 102 is opposed to the first threaded portion 97 of the rear beam 76, and each fifth penetration hole 108 is opposed to the threaded portion 85 of the side frame 83 of each drum subunit 28. The screw 92 is fitted into the first threaded portion 93 through the first penetration hole 100. Further, the screw 96 is fitted into the first threaded portion 97 through the third penetration hole 102. Thus, the first side plates 77 are combined with both sides of the front beam 75, the four drum subunits 28 and the rear beam 76 in the width direction, as shown in FIG. 11B.

Then, the photosensitive drums 29 are mounted on the right and left first side plates 77. While FIGS. 11B to 11E show a state where the photosensitive drums 29 excluding the headmost photosensitive drum 29 are already mounted, these photosensitive drums 29 can be mounted on the first side plates 77 by a method similar to that for mounting the headmost photosensitive drum 29.

First, the headmost photosensitive drum 29 is arranged on a position where both axial end portions thereof are opposed to the drum retaining holes 104 of the first side plates 77 in the width direction through the space between the corresponding drum subunit 28 and the front beam 75, as shown by broken lines in FIG. 11B. Then, one axial end portion (flange member 79) of this photosensitive drum 29 is inserted into the drum retaining hole 104 formed in one of the first side plates 77. Thereafter, another axial end portion (flange member 79) of the photosensitive drum 29 is inserted into the drum retaining hole 104 formed in the other first side plate 77. Thus, both axial end portions of the photosensitive drum 29 are exposed from the drum retaining holes 104 respectively, as shown in FIG. 11C.

Thereafter the left shaft receiving member 82 is combined with the left first side plate 77 and the flange member 79 provided on the left end portion of the photosensitive drum 29, as shown by broken lines in FIG. 11C. More specifically, the cylindrical portion 134 of the left shaft receiving member 82 is press-fitted into the space between the outer peripheral surface of the flange member 79 exposed from the drum retaining hole 104 of the left first side plate 77 and the drum retaining hole 104. Then, the left shaft receiving member 82 is press-fitted into the drum retaining hole 104 up to a position where the flange portion 135 thereof comes into contact with the outer side surface of the left first side plate 77. Thus, the left shaft receiving member 82 is so combined that the same is supported to be not rotatable with respect to the left first side plate 77 while the left flange member 79 is rotatably supported with respect to the left shaft receiving member 82.

Then, the right shaft receiving member 81 is combined with the right first side plate 77 and the flange member 79 provided on the right end portion of the photosensitive drum 29, as shown by broken lines in FIG. 11D. More specifically, the cylindrical portion 136 of the right shaft receiving member 81 is press-fitted into the space between the outer peripheral surface of the flange member 79 exposed from the drum retaining hole 104 of the right first side plate 77 and the drum retaining hole 104. Then, the right shaft receiving member 81 is press-fitted into the drum retaining hole 104 up to a position where the flange portion 137 thereof comes into contact with the outer side surface of the right first side plate 77. Thus, the right shaft receiving member 81 is so combined that the same is supported to be not rotatable with respect to the right first side plate 77 and the right flange member 79 is rotatably supported with respect to the right shaft receiving member 81.

Then, the clip member 106 is inserted into the engaging hole 139 formed on the earth shaft 138 of the right shaft receiving member 81, as shown in FIG. 11E. An end portion of the clip member 106 is bent and engaged with the engaging groove 105A of the right first side plate 77. The other end of the clip member 106 extends from the earth shaft 138 in the diametral direction of the flange portion 137 and is bent along the outer peripheral surface of the flange portion 137, to be engaged with the engaging groove 105B of the right first side plate 77. Thus, the right shaft receiving member 81 is pressed against the right first side plate 77 due to the elasticity of the clip member 106.

Then, each second side plate 78 is arranged on the outer side of each first side plate 77 in the width direction, as shown in FIG. 11F. Then, the second side plate 78 is combined with each first side plate 77, the front beam 75, the four drum subunits 28 and the rear beam 76 with screws 94, 98 and 107.

More specifically, each second side plate 78 is so arranged that one of the second screw insertion holes 111 is opposed to the corresponding second threaded portion 95 of the front beam 75, the other second screw insertion hole 111 is opposed to the second penetration hole 101 of the first side plate 77, the third screw insertion hole 112 is opposed to the fourth penetration hole 103 of the first side plate 77 and the first screw insertion holes 121 are opposed to the fifth penetration holes 108 of the first side plate 77. Then, the screws 94 are fitted into the second threaded portions 95 through the screw insertion hole ill and the second penetration hole 101. Further, the screw 98 is fitted into the second threaded portion 99 through the third screw insertion hole 112 and the fourth penetration hole 103. In addition, the screw 107 is fitted into the threaded portion 85 of each side frame 83 through the corresponding first screw insertion hole 121 and the corresponding fifth penetration hole 108. Thus, each second side plate 78 is combined with each first side plate 77, the front beam 75, the four drum subunits 28 and the rear beam 76, as shown in FIG. 11F.

3. Earthing of Photosensitive Drum

Figure 12:
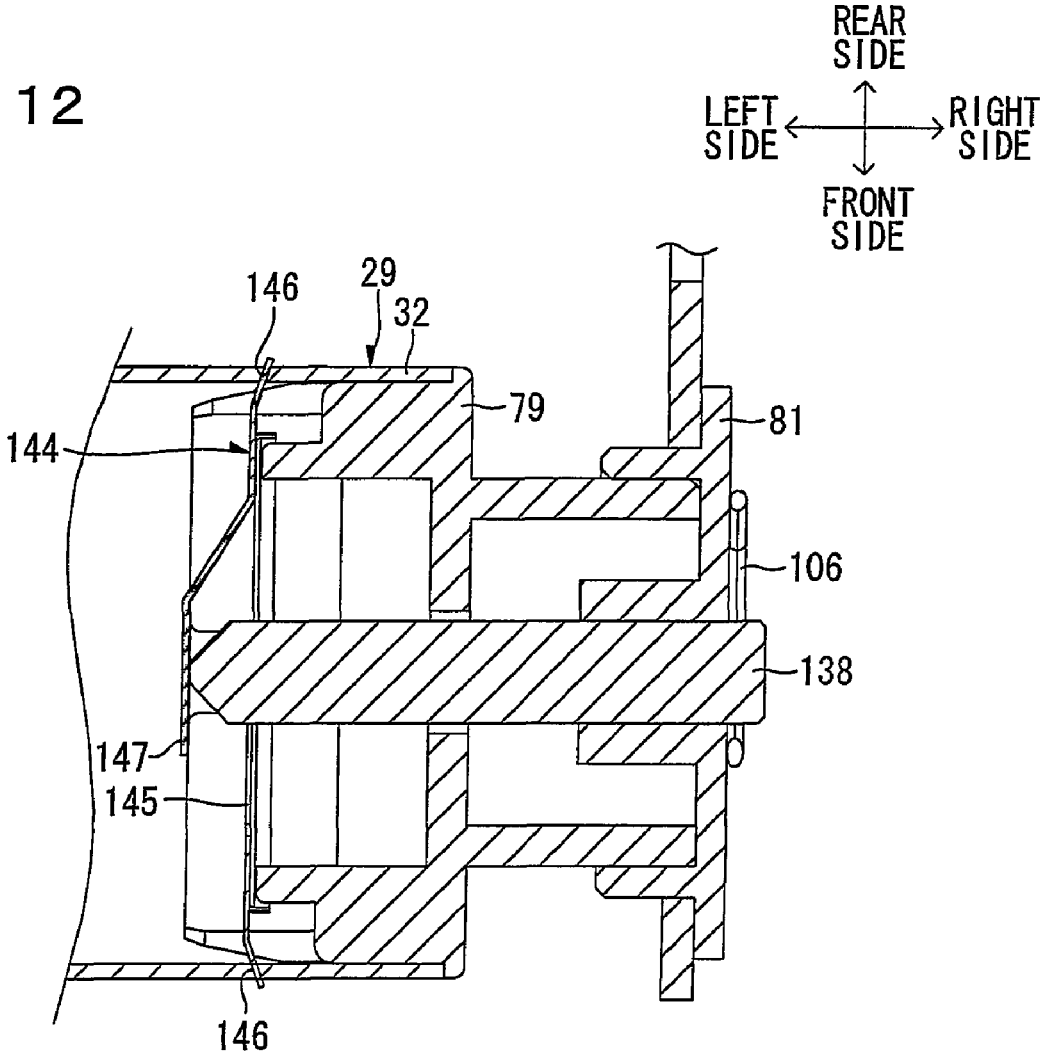
FIG. 12 is a sectional view of principal parts showing an earthing structure of each photosensitive drum.

FIG. 12 is a sectional view of principal parts showing an earthing structure of each photosensitive drum.

Each photosensitive drum 29 includes an electrode 144 for connecting the drum body 32 and the earth shaft 138 with each other in an electrically conductable manner.

The electrode 144 is formed by a metallic plate made of phosphor bronze, for example. This electrode plate includes an electrode plate body 145 generally in the form of a disc in side elevational view, contact portions 146 coming into contact with the inner peripheral surface of the drum body 32 and an arm portion 147 coming into contact with the earth shaft 138.

Four contact portions 146 are arranged at regular angular intervals (90 degrees) on the peripheral edge of the electrode plate body 145, for example. Each contact portion 146 protrudes outward in the diametral direction of the electrode plate body 145 from the peripheral edge of the electrode plate body 145.

One longitudinal end portion of the arm portion 147 is connected to the electrode plate body 145. Thus, the arm portion 147 is supported on the electrode plate body 145 in a cantilever state with a fixed end formed by the portion connected with the electrode plate body 145 and a free end formed by the end opposite to the fixed end in the longitudinal direction. The free end portion of the arm portion 147 is in contact with the earth shaft 138. Thus, the drum body 32 of the photosensitive drum 29 and the earth shaft 138 of the right shaft receiving member 81 are connected with each other in an electrically conductable manner through the electrode 144.

The earth shaft 138 of the right shaft receiving member 81 is pressed by the clip member 106 engaged with the engaging grooves 105A and 105B of the right first side plate 77, as shown in FIG. 11E. The first side plate 77 and the clip member 106 are made of metallic materials. Therefore, the drum body 32 of the photosensitive drum 29 and the earth shaft 138 of the right shaft receiving member 81 are electrically connected with each other, and the drum body 32 of the photosensitive drum 29 is connected to the first side plate 77 in an electrically conductable manner through the electrode 144, the earth shaft 138 and the clip member 106.

When the drum unit 26 is mounted in the main body casing 2, the main body reference shaft 115 described later enters the notched portion 172, so that the right first side plate 77 can be earthed through the main body reference shaft 115. Further, the right first side plate 77 and the photosensitive drum 29 are electrically connected with each other through the right shaft receiving member 81, whereby the photosensitive drum 29 can be earthed through the right shaft receiving member 81, the right first side plate 77 and the main body reference shaft 115.

The right shaft receiving member 81 is made of a conductive resin material. Therefore, the photosensitive drum 29, electrically conductable to the first side plate 77 through the cylindrical portion 134 (see FIG. 9) of the right shaft receiving member 81 press-fitted into the first side plate 77, can be earthed without the aforementioned clip member 106. The photosensitive drum 29 can be earthed through the aforementioned clip member 106 if the aforementioned right shaft receiving member 81 is not made of a conductive material, while the photosensitive drum 29 is desirably earthed through both of the right shaft receiving member 81 and the clip member 106.

4. Developer Cartridge

The coupling passive gear 123 is arranged on a left sidewall 149 of the casing 36 of each developer cartridge 27, as shown in FIG. 3. When each developer cartridge 27 is mounted between the right and left second side plates 78, each coupling passive gear 123 is opposed to each developer coupling insertion hole 122. A drive input shaft (not shown) is inserted into each developer coupling insertion hole 122 and coupled to each coupling passive gear 123, so that the driving force from the motor (not shown) provided in the main body casing 2 can be transmitted to each coupling passive gear 123 through each drive input shaft.

In each developer cartridge 27, developer pressing bosses 150 are provided on front upper portions of both sidewalls 149 to protrude outward from the sidewalls 149 in the width direction. When the developer cartridges 27 are mounted on the drum unit 26, the developer pressing bosses 150 come into contact with the link levers 142 described later from above, and are pressed by the pressing members 143 described later from above.

5. Pressing Member

Figure 13:
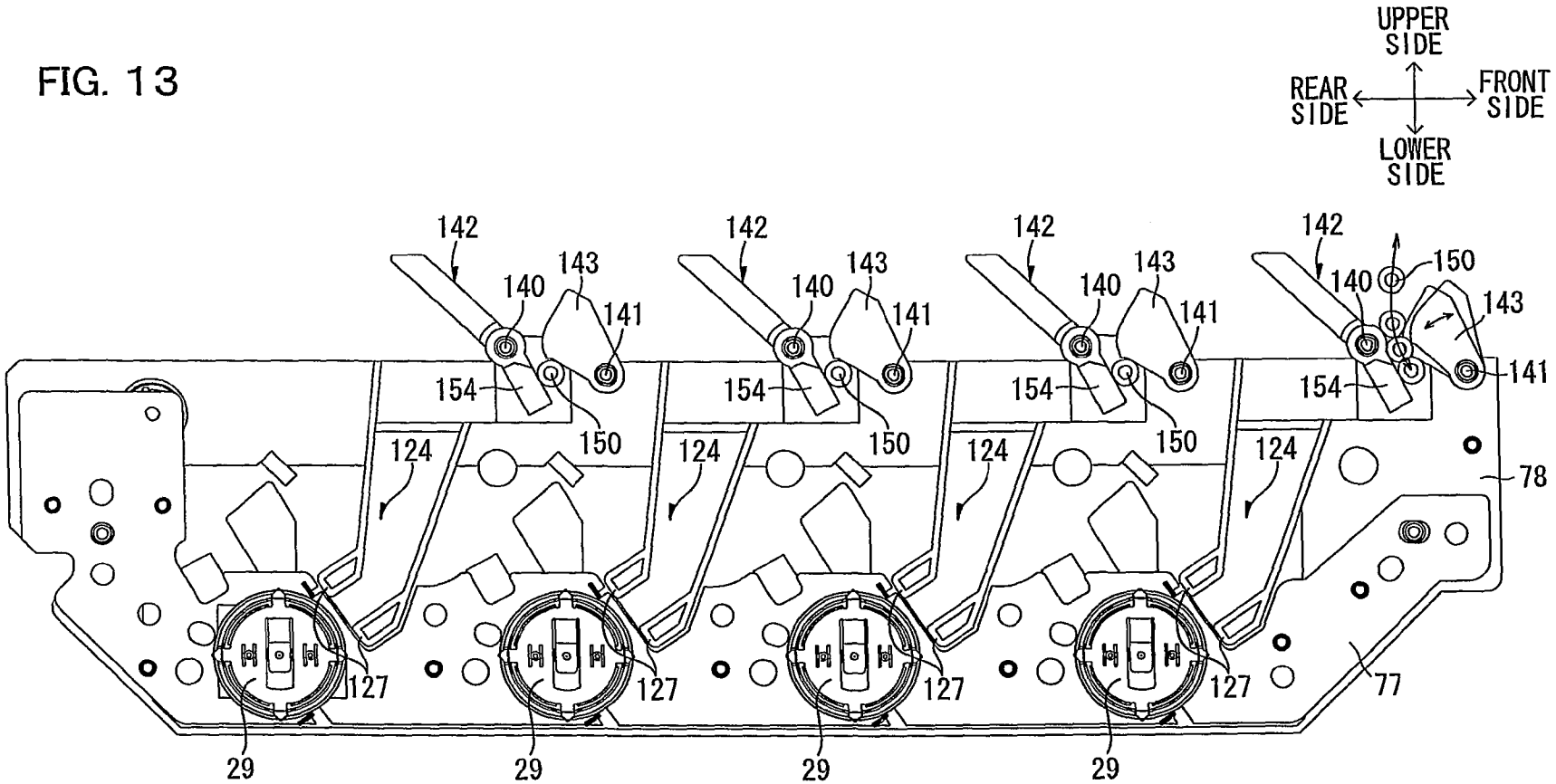
FIG. 13 is a partial sectional view of the drum unit as viewed from the left side.
Figure 14:
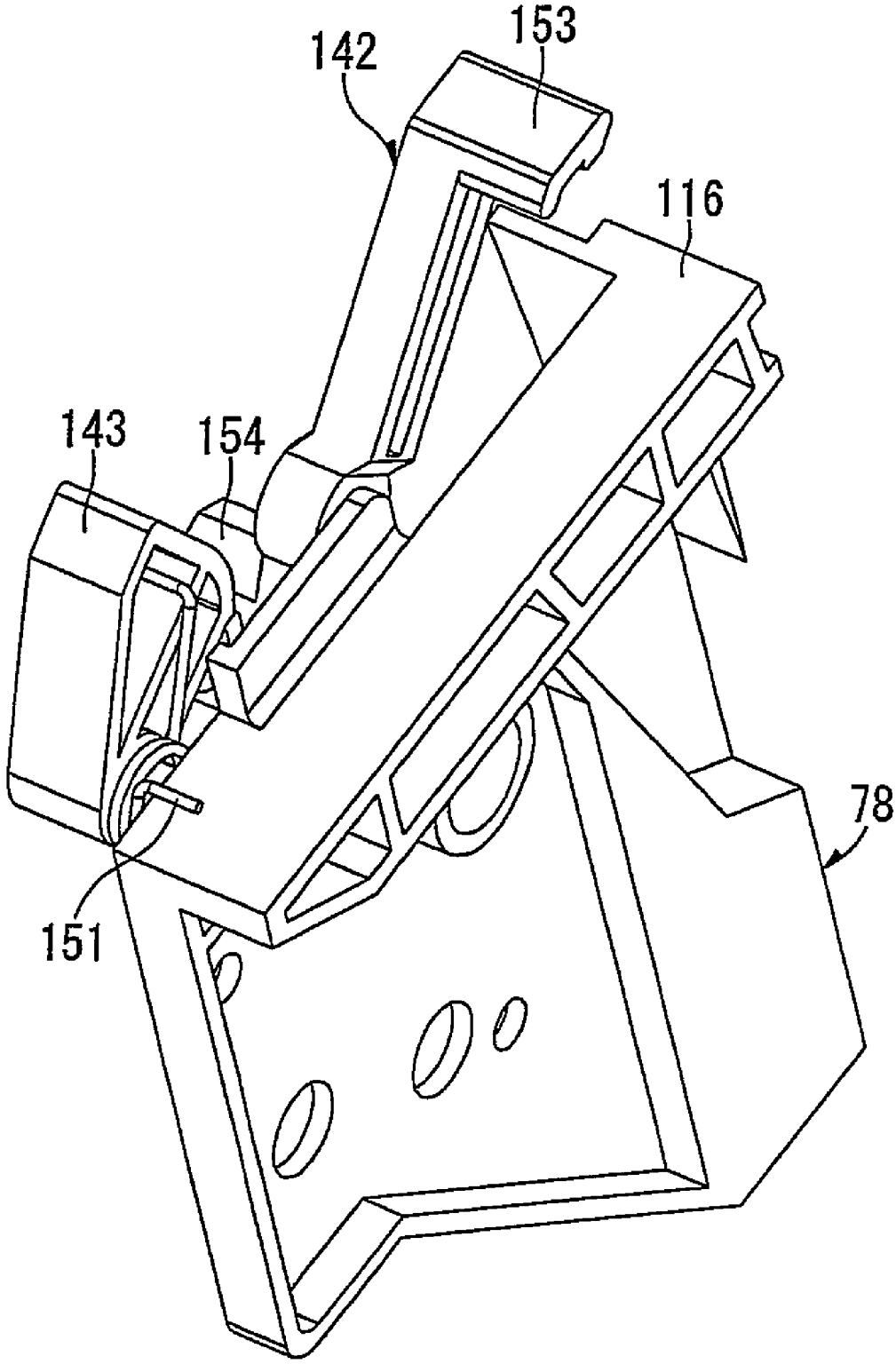
FIG. 14 is a perspective view of principal parts of each pressing member and each link lever shown in FIG. 13.

FIG. 13 is a partial sectional view of the drum unit as viewed from the left side. FIG. 14 is a perspective view of principal parts of each pressing member and each link lever shown in FIG. 13.

The drum unit 26 includes four pressing members 143, as shown in FIG. 13.

Each pressing member 143 is in the form of a generally triangular plate. The corresponding second support shaft 141 of the second side plate 78 is inserted into one corner portion of the pressing member 143, to swingably support the pressing member 143. The pressing member 143 is so provided as to extend from the second support shaft 141 obliquely toward a rear upper side.

The forward end portion of the pressing member 143 is urged downward by a coil spring 151 wound on the corresponding second support shaft 141, as shown in FIG. 14. An end of the coil spring 151 is engaged on the flange portion 116 of the second side plate 78, while the other end thereof is wound on the second support shaft 141 and thereafter engaged with the pressing member 143.

6. Link lever

As shown in FIG. 13, the drum unit 26 includes four link levers 142.

Each link lever 142 is in the form of an elongated rectangle in side elevational view. An intermediate portion of the link lever 142 in the longitudinal direction is swingably supported on the corresponding first support shaft 140 of the second side plate 78. An end portion of the link lever 142 is in the form of a plate extending in the right-and-left direction, to form an acting portion 153 receiving force from a cam portion 158 described later, as shown in FIG. 14. The other end portion of the link lever 142 forms a spacing portion 154 whose width in the right-and-left direction is rendered larger than the width of the end portion for pressing the developer pressing boss 150 (see FIG. 13) of the corresponding developer cartridge 27.

7. Mounting of Developer Cartridge

The developer cartridge 27 of each color is mounted between the right and left second side plates 78 from above, as shown in FIG. 3. At this time, both end portions of the roller shafts 51 protruding from both side surfaces of the casing 36 of the developer cartridge 27 in the width direction are introduced into the corresponding cartridge guide portions 124 from above. Then, the developer cartridge 27 is moved downward while both end portions of the roller shafts 51 are guided by the cartridge guide portions 124. When the developer cartridge 27 is guided into the corresponding cartridge retaining portion 127 (see FIG. 7B) and the developing roller 39 comes into contact with the photosensitive drum 29, the developer cartridge 27 is inhibited from further movement, and the developing roller 39 is positioned with respect to the photosensitive drum 29. Thereafter the developer cartridge 27 is slightly inclined frontward.

Thus, the developer pressing boss 150 of each developer cartridge 27 slips into the space under the pressing member 143 through the space between the pressing member 143 and the spacing portion 154 of the link lever 142 to lift the pressing member 143 from below against the urging force of the coil spring 151, as shown in FIG. 13. Consequently, the developer pressing boss 150 is urged downward by the pressing member 143, to press the developer cartridge 27. In this state, the developer pressing boss 150 is in contact with the spacing portion 154 of the link lever 142 from the front side.

According to this embodiment, the color laser printer 1 employs the contact one-component developing system, to require no positional accuracy of the developing roller 39. Therefore, the first side plate 77 may not be employed for positioning the developing roller 39.

8. Internal Structure of Main Body Casing

Figure 15:
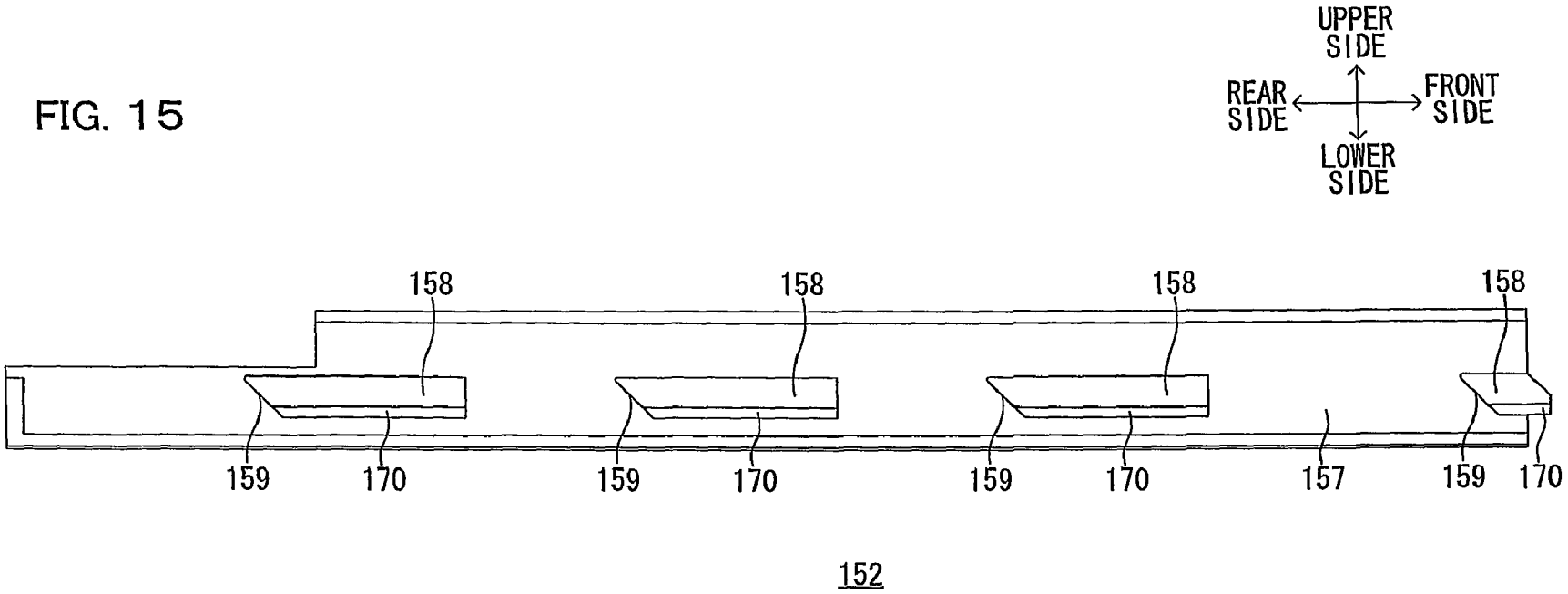
FIG. 15 is a side elevational view of a translation cam provided on a main body casing shown in FIG. 1.
Figure 16:
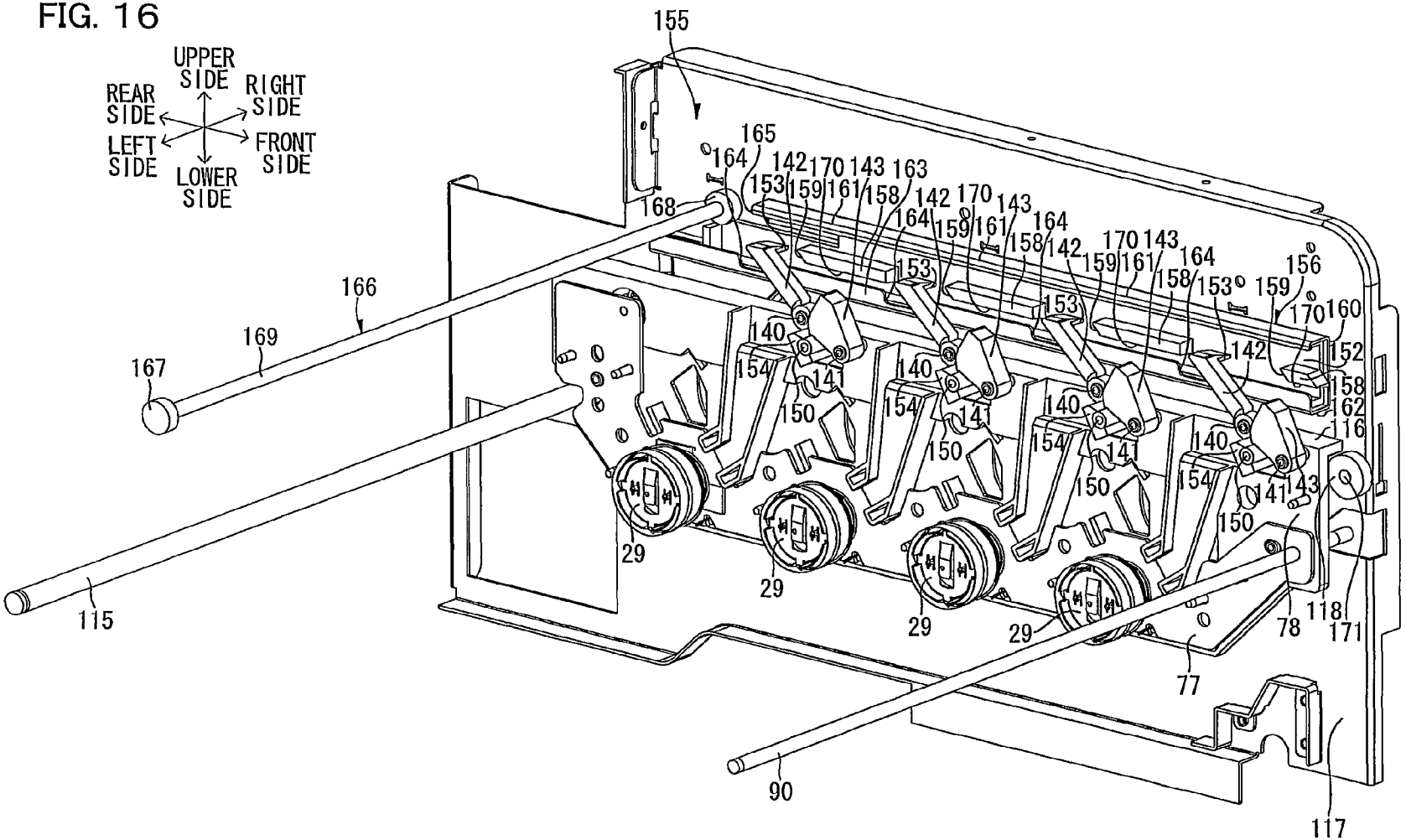
FIG. 16 is a perspective view of principal parts showing a state where all developer cartridges are in pressure contact with the photosensitive drums.
Figure 17:
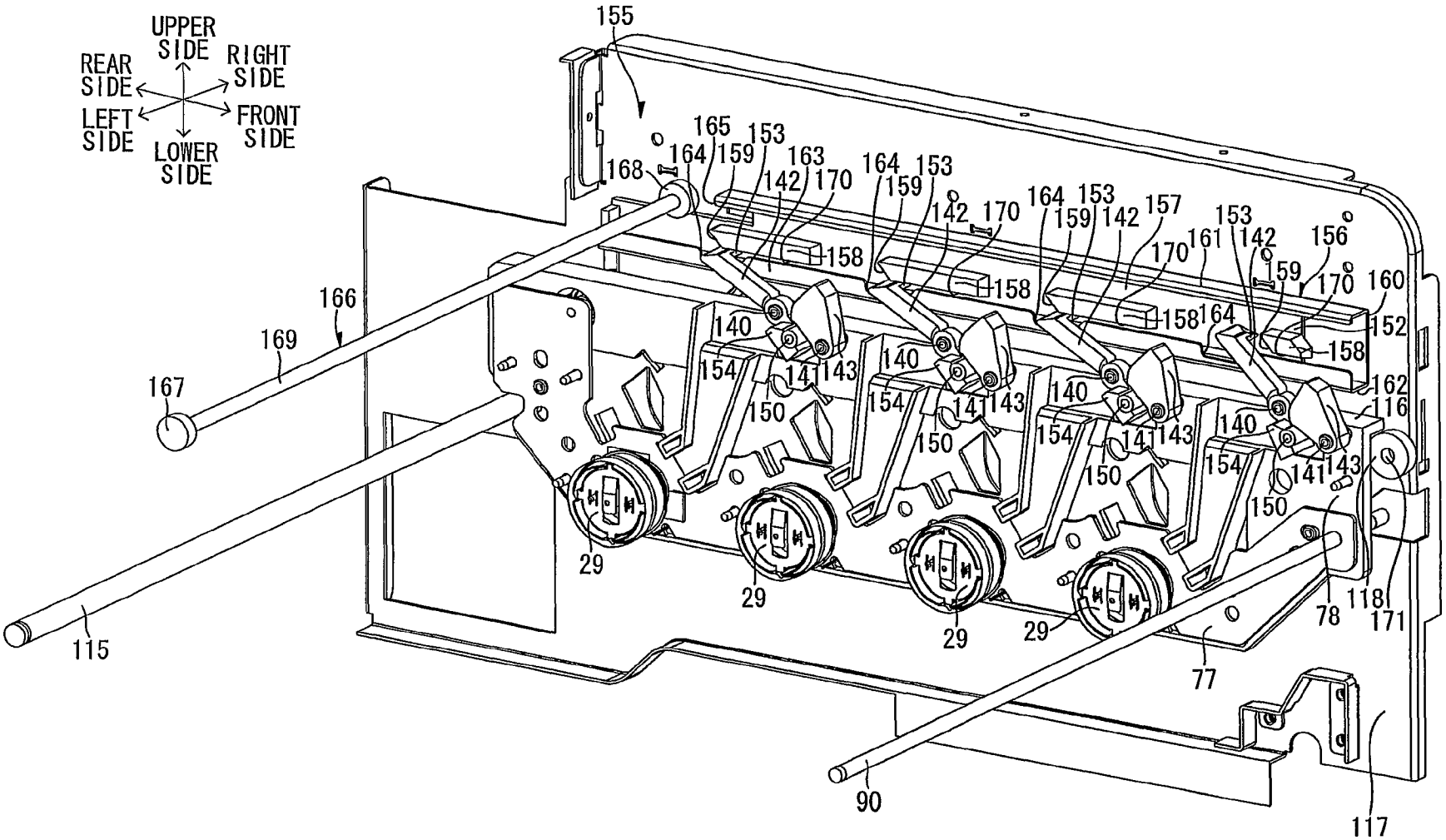
FIG. 17 is a perspective view of principal parts showing a state where only a black developer cartridge is in pressure contact with the corresponding photosensitive drum.
Figure 18:
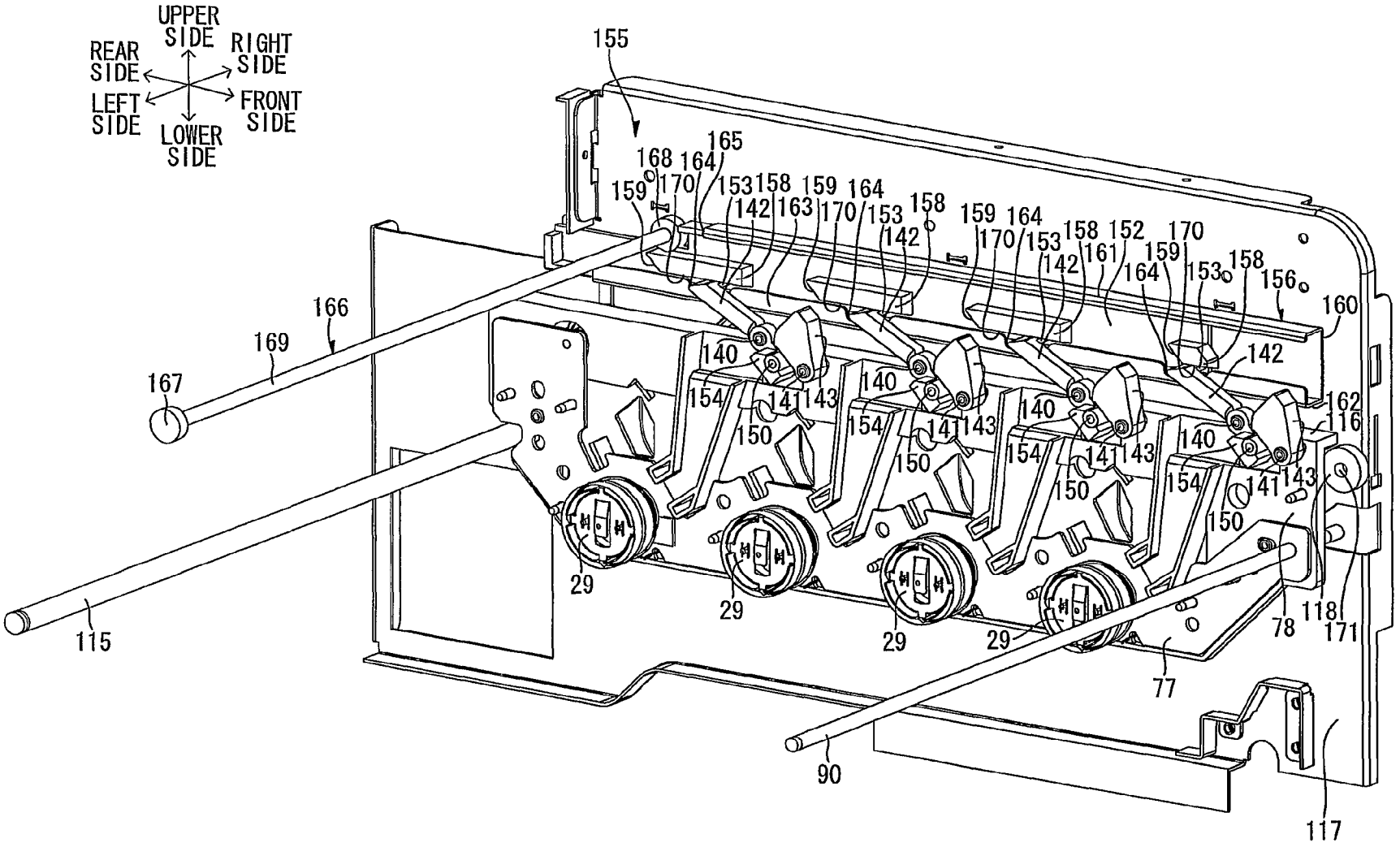
FIG. 18 is a perspective view of principal parts showing a state where all developer cartridges are separated from the photosensitive drums.

FIG. 15 is a side elevational view of a translation cam provided on the main body casing 2. FIG. 16 is a perspective view of principal parts showing a state where all developer cartridges are in pressure contact with the photosensitive drums. FIG. 17 is a perspective view of principal parts showing a state where only the black developer cartridge is in pressure contact with the corresponding photosensitive drum. FIG. 18 is a perspective view of principal parts showing a state where all developer cartridges are separated from the photosensitive drums.

The main body casing 2 is provided therein with a pair of main body side plates 117 (FIGS. 16 to 18 show only the right main body side plate 117) opposed to each other at an interval in the width direction. A roller shaft 171 extending inward in the width direction is supported on the front end portion of each main body side plate 117. A roller member 118 for coming into contact with the flange portion 116 of each second side plate 78 of the drum unit 26 from below and slidably guiding the drum unit 26 into a drum receiving space 7 is supposed by each roller shaft 171.

The main body reference shaft 115 is extended between the rear end portions of the right and left main body side plates 117.

In order to mount the drum unit 26 in the main body casing 2, the front cover 9 of the main body casing 2 is first opened. Then, the rear edge of the flange portion 116 of each second side plate 78 of the drum unit 26 is brought into contact with the roller member 118 from above. Thereafter the drum unit 26 is so moved rearward that the flange portion 116 of each second side plate 78 slides on the roller member 118 and the drum unit 26 is guided into the main body casing 2. When the roller member 118 comes into contact with the inclined surface 173 provided on the front side of each flange portion 116 so that the drum unit 26 entirely moves downward and the notched portion 172 of each first side plate 77 comes into contact with the main body reference shaft 115, the drum unit 26 is inhibited from further movement. Thus, the drum unit 26 is completely mounted in the main body casing 2.

The drum unit 26 is detached from the main body casing 2 by an operation reverse to the aforementioned operation.

9. Spacing Mechanism

The main body casing 2 is provided therein with a spacing mechanism 155 for displacing each developer cartridge 27 between a contact position coming into contact with each photosensitive drum 29 and a separating position separating from each photosensitive drum 29.

The spacing mechanism 155 includes a pair of translation cams 152, rails 156 retaining the translation cams 152 to be linearly movable in the anteroposterior direction and a synchronized movement mechanism 166 for linearly moving the pair of translation cams 152 in a synchronized manner.

(1) Translation Cam

The translation cams 152 are provided on the right and left sides in the main body casing 2 respectively. FIGS. 16 to 18 show only the right translation cam 152. The right and left translation cams 152 are identical in structure to each other, and hence the right translation cam 152 is described below.

The translation cam 152 integrally includes a translation cam body plate 157 and four cam portions 158 provided on the inner side surface of the translation cam body plate 157.

The translation cam body plate 157 is generally in the form of an elongated rectangle in side elevational view extending in the anteroposterior direction, and the rear end portion thereof is rectangularly notched in side elevational view from the upper surface, as shown in FIG. 15. Further, the translation cam body plate 157 is generally U-shaped in section, and the upper and lower edges thereof are bent inward in the width direction.

The four cam portions 158 are provided correspondingly to the developer cartridges 27 (see FIG. 3) of the respective colors. The cam portions 158 protrude inward in the width direction at intervals from one another on the inner side surface of the translation cam body plate 157, and are generally rectangular in side elevational view. The rear end portion of each cam portion 158 form a first inclined surface 159 inclined from the lower edge thereof toward rear upper side. The lower end portion of each cam portion 158 form a second inclined surface 170 inclined toward inner upper side in the width direction from the translation cam body plate 157.

The rear three cam portions 158 (three cam portions 158 other than the headmost cam portion 158) are so formed that the intervals between the adjacent cam portions 158 are equal to each other. The headmost cam portion 158 is so formed that the interval between the same and the cam portion 158 adjacent thereto is a second interval larger than the interval between the rear three cam portions 158.

(2) Rail

Rails 156 are provided on the right and left sides in the main body casing 2 respectively. The right and left rails 156 are identical in structure to each other, and hence the right rail 156 is described below.

The rail 156 includes a main portion 160 generally rectangular in side elevational view fixed to the main body side plate 117 to extend in the anteroposterior direction, a first flange portion 161 extending inward in the width direction from the upper edge of the main portion 160 and a second flange portion 162 extending inward in the width direction from the lower edge of the main portion 160, as shown in FIG. 16.

The second flange portion 162 has a stopper 163 further extending upward from the inner edge thereof in the width direction. Four recesses 164 notched from the upper end of the stopper 163 are formed on an intermediate portion of the stopper 163 in the anteroposterior direction.

A notched portion 165 rectangularly notched from the upper surface in side elevational view is formed on the rear end portions of the main portion 160 and the first flange portion 161. The corresponding translation cam 152 is so arranged on the second flange portion 161 that the cam portions 158 protrude inward in the width direction. The translation cam 152 is slidable along the rail 156, and the rear end portion thereof is regularly exposed upward from the notched portion 165, regardless of the position of the translation cam 152.

(3) Synchronized Movement Mechanism

The synchronized movement mechanism 166 is so structured as to transmit driving force for linear movement from the left translation cam 152 to the right translation cam 152 following linear movement of the left translation cam 152, for example.

In other words, the synchronized movement mechanism 166 includes a left rack gear (not shown) formed on the upper surface of the rear end portion of the left translation cam 152, a left pinion gear 167 meshing with the left rack gear, a right rack gear (not shown) formed on the upper surface of the rear end portion of the right translation cam 152, a right pinion gear 168 meshing with the right rack gear and a connecting shaft 169 on which the left and right pinion gears 167 and 168 are mounted to be not relatively rotatable.

The driving force from the motor (not shown) is input in the left translation cam 152.

(4) Spacing/Pressing Operation

The operation of the spacing mechanism 155 is described mainly with reference to FIGS. 16 to 18.

When the drum unit 26 is mounted in the main body casing 2 and each translation cam 152 is moved to the headmost position as shown in FIG. 16, the first inclined surface 159 of each cam portion 158 and the acting portion 153 of the link lever 142 arranged at the back thereof are opposed to each other in a non-contact state at an interval in the anteroposterior direction. An interval larger than those between the first inclined surfaces 159 of the rear three cam portions 158 and the acting portions 153 of the link levers 142 arranged at the back thereof is formed between the first inclined surface 159 of the headmost cam portion 158 and the acting portion 153 of the link lever 142 arranged at the back thereof.

In this state, each developer cartridge 27 is arranged on the contact position where the developing roller 39 and the photosensitive drum 29 are in contact with each other. Each pressing member 143 comes into contact with the developer pressing boss 150 of each developer cartridge 27 from above, to press each developer pressing boss 150 downward.

When the driving force of the motor (not shown) is input in an input rack gear of the left translation cam 152 to move the left translation cam 152 rearward from this state, the left pinion gear 167 rotates following this movement of the left translation cam 152, and this rotation of the left pinion gear 167 is transmitted to the right pinion gear 168 through the connecting shaft 169 so that the right pinion gear 168 rotates in the same direction as the left pinion gear 167, thereby moving the right translation cam 152 rearward.

When the rearward movement of each translation cam 152 progresses, the first inclined surfaces 159 of the rear three cam portions 158 come into contact with the acting portions 153 of the link levers 142 arranged at the back thereof, to press end portions of the rear three link levers 142 rearward. Thus, each link lever 142 so pivots on the first support shaft 140 as to lift the other end portion (spacing portion 154) upward. In the process of this pivoting of each link lever 142, the spacing portion 154 of the link lever 142 comes into contact with the developer pressing boss 150 positioned above the same from below, to push up the developer pressing boss 150. Thus, yellow, magenta and cyan developer cartridges 27Y, 27M and 27C are lifted upward against the pressing force of the corresponding pressing members 143.

When the rearward movement of the translation cam 152 further progresses and the acting portions 153 of the link levers 142 come into contact with the second inclined surfaces 170 of the rear three cam portions 158 as shown in FIG. 17, the yellow, magenta and cyan developer cartridges 27Y, 27M and 27C are arranged on the separating positions, and the developing rollers 39 of the yellow, magenta and cyan developer cartridges 27Y, 27M and 27C separate from the photosensitive drums 29. At this time, the developer pressing boss 150 of a black developer cartridge 27K is pressed by the corresponding pressing member 143. Thus, only the developing roller 39 of the black developer cartridge 27K is pressed against the corresponding photosensitive drum 29. At this time, the acting portion 153 of each link lever 142 enters the corresponding recess 164 of the rail 156. Each second inclined surface 170 is inclined toward an inner upper side in the width direction from the translation cam body plate 157. Therefore, the pressing force applied to the acting portion 153 of the link lever 142 from the second inclined surface 170 of the cam portion 158 includes an inward force component in the width direction. The link lever 142 is fixed to the drum unit 26 through the first support shaft 140. Consequently, the drum unit 26 can be positioned in the width direction.

When the rearward movement of the translation cam 152 thereafter further progresses, the first inclined surface 159 of the headmost cam portion 158 comes into contact with the acting portion 153 of the link lever 142 arranged at the back thereof, to press an end portion of the headmost link lever 142 toward a rear lower side. Thus, the link lever 142 so pivots on the first support shaft 140 as to lift the other portion (spacing portion 154) upward. In the process of this pivoting of the link lever 142, the spacing portion 154 of the link lever 142 comes into contact with the developer pressing boss 150 positioned above the same from below, to push up the developer pressing boss 150. Thus, the black developer cartridge 27K is lifted upward against the pressing force applied by the pressing member 143.

When the rearward movement of the translation cam 152 further progresses and the acting portion 153 of the link lever 142 comes into contact with the second inclined surface 170 of the headmost cam portion 158 as shown in FIG. 18, the black developer cartridge 27K is arranged on the separating position, and the developing roller 39 of the black developer cartridge 27K separates from the photosensitive drum 29. Thus, the developing rollers 39 of all developer cartridges 27 separate from the photosensitive drums 29.

At this time, the acting portion 153 of each link lever 142 enters the corresponding recess 164 formed on the stopper 163 of the second flange portion 162 of the rail 156. The link lever 142 is in contact with the second inclined surface 170, whereby the drum unit 26 is positioned in the width direction by the second inclined surface 170. The second inclined surface 170 is inclined toward an inner upper side in the width direction from the translation cam body plate 157. Therefore, the pressing force applied to the acting portion 153 of the link lever 142 from the second inclined surface 170 of the cam portion 158 includes an inward force component in the width direction. The link lever 142 is fixed to the drum unit 26 through the first support shaft 140. Consequently, the drum unit 26 can be positioned in the width direction.

The color laser printer 1 can be returned from the state shown in FIG. 18 to the states shown in FIGS. 16 and 17 respectively by moving the translation cam 152 frontward. When the first inclined surface 159 of each cam portion 158 and the acting portion 153 of the link lever 142 positioned at the back thereof are separated from each other at this time, the upward force applied from the link lever 142 to the developer pressing boss 150 is canceled. Then, the developer cartridge 27 is pressed downward by the pressing member 143, to be arranged on the contact position where the developing roller 39 and the photosensitive drum 29 are in contact with each other.

10. Functions/Effects

According to the aforementioned embodiment, as hereinabove described, the tandem type photosensitive unit is constituted of the pair of first side plates 77, the pair of second side plates 78, the front beam 75, the rear beam 76 and the four drum subunits 28.

The drum unit 26 retains the four photosensitive drums 29 in the parallelly arranged state. The developer cartridges 27 retaining the developing rollers 39 are detachably mounted on the drum unit 26. The link lever 142 is provided correspondingly to each developer cartridge 27. Each link lever 142 is swingably supported on the corresponding first support shaft 140 projectingly provided on the drum unit 26. The drum unit 26 is mounted in the main body casing 2 to be movable along the direction (hereinafter referred to simply as "arrangement direction" in this section) of the arrangement of the photosensitive drums 29. The translation cams 152 are provided in the main body casing 2 to be linearly movable in the arrangement direction.

When each developer cartridge 27 is mounted on the drum unit 26, the end portion of the link lever 142 is opposed to a prescribed portion of each developer cartridge 27. The other end portion of the link lever 142 is pressed by the translation cam 152 following linear movement of the translation cam 152, so that the end portion of the link lever 142 presses the prescribed portion of the developer cartridge 27 in the direction for separating the developing roller 39 from the photosensitive drum 29. Thus, the developing roller 39 can be separated from the photosensitive drum 29. The translation cam 152 is released from pressing the other end portion of the link lever 142 by further linear movement from this state, so that the end portion of the link lever 142 is released from pressing the prescribed portion of the developer cartridge 27.

Thus, the first support shaft 140 provided on the drum unit 26 supports the link lever 142, which in turn swings on the first support shaft 140 so that the developing roller 39 approaches to/separates from the photosensitive drum 29. Therefore, the pressing force applied from the translation cam 152 to the link lever 142 does not act on the drum unit 26. Consequently, the drum unit 26 can be prevented from positionally deviating from the main body casing 2 when the developing roller 39 is separated from the photosensitive drum 29.

The main body casing 2 has the main body reference shaft 115 extending in the axial direction of the photosensitive drums 29. The drum unit 26 comes into contact with the main body reference shaft 115 in the state mounted in the main body casing 2. Thus, the drum unit 26 is positioned with respect to the main body. The direction of the pressing force applied from the translation cam 152 to the other end portion of each link lever 142 is generally identical to the direction where the drum unit 26 comes into contact with the main body reference shaft 115. Even if force acts from the translation cam 152 to the drum unit 26 through the link lever 142, therefore, the direction of this force is generally identical to the direction where the drum unit 26 comes into contact with the main body reference shaft 115. When each developing roller 39 is separated from the corresponding photosensitive drum 29, therefore, the drum unit 26 can be prevented from positionally deviating from the main body casing 2.

The translation cam 152 is provided with the cam portion 158 for pressing the other end portion of the link lever 142 correspondingly to the link lever 142. When coming into contact with the other end portion of the link lever 142, the cam portion 158 presses the other end portion of the link lever 142. When separating from the other end portion of the link lever 142, on the other hand, the cam portion 158 is released from pressing the other end portion of the link lever 142. Therefore, the link lever 142 can so swing as to separate the developing roller 39 from the photosensitive drum 29 due to the simple structure of the cam portion 158 provided on the translation cam 152.

Further, the cam portion 158 can be switched to a first state where every cam portion 158 comes into contact with the other end portion of the corresponding link lever 142, a second state where at least one cam portion 158 comes into contact with the other end portion of the corresponding link lever 142 while the remaining cam portions 158 separate from the other end portions of the corresponding link levers 142 and a third state where every cam portion 158 separates from the other end portion of the corresponding link lever 142, due to the linear movement of the translation cam 152.

The developer cartridges 27 are provided correspondingly to black, yellow, magenta and cyan respectively. In the first state, the cam portions 158 come into contact with the other end portions of the link levers 142 of all colors, so that the developing rollers 39 of all colors are separated from the photosensitive drums 29. In the second state, the corresponding cam portions 158 come into contact with the other end portions of the link levers 142 corresponding to yellow, magenta and cyan respectively, so that the developing rollers 39 of yellow, magenta and cyan are separated from the photosensitive drums 29 while the black developing roller 39 comes into contact with the photosensitive drum 29. In the third state, the cam portions 158 separate from the other end portions of the link levers 142 of all colors, so that the developing rollers 39 of all colors come into contact with the photosensitive drums 29. Therefore, the yellow, magenta and cyan developing rollers 39 can be prevented from consumption by bringing the cam portions 158 into the second state in formation of a monochromatic image.

Further, the surface of each cam portion 158 coming into contact with the other end portion of the corresponding link lever 142 is formed into the second inclined surface 170 inclined with respect to the axial direction of the corresponding photosensitive drum 29. Therefore, the pressing force applied from the cam portion 158 to the other end portion of the link lever 142 includes a force component in the axial direction of the photosensitive drum 29. Consequently, force in the axial direction of the photosensitive drum 29 acts on the drum unit 26, whereby the drum unit 26 can be positioned in this axial direction.

The pressing member 143 is provided correspondingly to each developer cartridge 27, for pressing the developer cartridge 27 in the direction where the corresponding developing roller 39 and the corresponding photosensitive drum 29 are opposed to each other. This pressing member 143 can press the developing roller 39 against the photosensitive drum 29. Consequently, the developing roller 39 can excellently feed the corresponding toner to the photosensitive drum 29.

Each second support shaft 141 is projectingly provided on the drum unit 26. The second support shaft 141 swingably supports the pressing member 143, which in turn is elastically pressed against the prescribed portion of the corresponding developer cartridge 27 by the coil spring 151. Thus, the developing roller 39 can be pressed against the photosensitive drum 29.

11. Other Embodiment

While the single main body reference shaft 115 extended between the rear end portions of the right and left main body side plates 117 is employed in the aforementioned embodiment as an example of the main body reference shaft in the aforementioned embodiment, main body reference shafts 115 may alternatively be formed by two shafts protruding from the right and left main body side plates 117 in directions opposed to each other to be arranged on the same straight line. In this case, the forward end portion of each main body reference shaft 115 is arranged inward beyond the notched portion 74 formed on each first side plate 77 in the right-and-left direction when the drum unit 26 is mounted in the main body casing 2.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

a main body;

a tandem type photosensitive unit, integrally retaining a plurality of photosensitive drums in a parallelly arranged state, mounted in the main body to be movable along the direction of the arrangement of the photosensitive drums;

a developer cartridge provided correspondingly to each photosensitive drum, retaining a developing roller for feeding a developer to the corresponding photosensitive drum and detachably mounted on the tandem type photosensitive unit;

a translation member provided in the main body to be linearly movable in the direction of the arrangement; and a link member provided correspondingly to each developer cartridge, swingably supported on a first support shaft projectingly provided on the tandem type photosensitive unit and displaced to a pressing position where a first end portion thereof is opposed to a prescribed portion of each developer cartridge while a second end portion opposite to the first end portion is pressed by the translation member following linear movement of the translation member so that the first end portion presses the prescribed portion in a direction for separating the developing roller from the photosensitive drum and a releasing position where the translation member is released from pressing the second end portion so that the first end portion is released from pressing the prescribed portion, while each developer cartridge is mounted on the tandem type photosensitive unit.

2. The image forming apparatus according to claim 1, wherein the main body has a main body reference shaft extending in the axial direction of the photosensitive drums, the tandem type photosensitive unit comes into contact with the main body reference shaft when mounted in the main body, and the direction where the tandem type photosensitive unit comes into contact with the main body reference shaft and the direction of pressing force applied from the translation member to the second end portion of each link member are generally identical to each other.

3. The image forming apparatus according to claim 1, wherein the translation member includes a cam portion provided correspondingly to each link member for coming into contact with the second end portion of the link member and pressing the second end portion.

4. The image forming apparatus according to claim 3, wherein the cam portion is arranged to be capable of taking a first state where every cam portion comes into contact with the second end portion of the link member, a second state where at least one cam portion comes into contact with the second end portion of the link member and a third state where every cam portion separates from the second end portion of the link member.

5. The image forming apparatus according to claim 4, wherein the developer cartridges are provided correspondingly to colors of black, yellow, magenta and cyan respectively, and the second state is a state where the cam portion comes into contact with the second end portion of the link member corresponding to each of yellow, magenta and cyan while the cam portion separates from the second end portion of the link member corresponding to black.

6. The image forming apparatus according to claim 3, wherein a surface of the cam portion coming into contact with the second end portion of the link member is formed as an inclined surface inclined with respect to the axial direction of the photosensitive drums.

7. The image forming apparatus according to claim 1, further comprising a pressing mechanism provided correspondingly to each developer cartridge for pressing each developer cartridge in a direction where each developing roller and each photosensitive drum are opposed to each other while each developer cartridge is mounted on the tandem type photosensitive unit.

8. The image forming apparatus according to claim 7, wherein the pressing mechanism includes a pressing member swingably supported on a second support shaft projectingly provided on the tandem type photosensitive unit for coming into contact with the prescribed portion of each developer cartridge and a spring elastically pressing the pressing member against the prescribed portion.

* * * * *